US008607997B2

(12) United States Patent
Bergdoll et al.

(10) Patent No.: US 8,607,997 B2
(45) Date of Patent: Dec. 17, 2013

(54) MODULAR MERCHANDISE DISPLAY SYSTEM

(75) Inventors: James Bergdoll, East Setauket, NY (US); Michael Mongelluzzo, East Quogue, NY (US); Gary Rein, New York, NY (US)

(73) Assignee: Summit Plastics, Inc., Bayshore, NY (US)

( * ) Notice: Subject to any disclaimer, the term of this patent is extended or adjusted under 35 U.S.C. 154(b) by 0 days.

(21) Appl. No.: 12/932,162

(22) Filed: Feb. 18, 2011

(65) Prior Publication Data

US 2012/0012547 A1 Jan. 19, 2012

Related U.S. Application Data

(60) Provisional application No. 61/338,408, filed on Feb. 18, 2010.

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47F 1/04*** | (2006.01) |
| ***A47F 7/00*** | (2006.01) |

(52) U.S. Cl.

USPC ..... 211/187; 211/59.3

(58) Field of Classification Search

USPC ..... 211/189, 87.01, 175, 207, 103, 187; 312/247, 246, 245, 405.1, 408; 108/108, 110, 144.11, 146, 147.11

See application file for complete search history.

(56) References Cited

U.S. PATENT DOCUMENTS

| | | | | |
|---|---|---|---|---|
| 3,794,183 | A * | 2/1974 | Colbridge | 211/208 |
| 4,934,645 | A * | 6/1990 | Breslow | 248/242 |
| 5,660,287 | A * | 8/1997 | Tryon | 211/186 |
| 6,105,791 | A | 8/2000 | Chalson et al. | 211/59.3 |
| 7,950,538 | B2 * | 5/2011 | Zang et al. | 211/187 |
| 2008/0087621 | A1 * | 4/2008 | Zang et al. | 211/187 |
| 2008/0121146 | A1 * | 5/2008 | Burns et al. | 108/23 |

* cited by examiner

*Primary Examiner* — Darnell Jayne
*Assistant Examiner* — Kimberley S Wright
(74) *Attorney, Agent, or Firm* — Gerald T. Bodner

(57) ABSTRACT

A modular merchandise display system includes a frame and a plurality of merchandise supporting units. The frame has a pair of spaced apart, parallelly disposed indexing members, and each indexing member has a plurality of openings formed therein. Each merchandise supporting unit has a front side and an opposite rear side, a pair of spaced apart pins extending outwardly from the rear side which are receivable in corresponding openings in each indexing member, and a pair of locking wings which selectively engage the indexing members to secure with the pins the merchandise supporting units to the indexing members of the frame.

30 Claims, 43 Drawing Sheets

MODULAR MERCHANDISE DISPLAY SYSTEM

CROSS-REFERENCE TO RELATED APPLICATIONS

This application is related to U.S. Provisional Application Ser. No. 61/338,408, which was filed on Feb. 18, 2010, and is entitled "Modular Merchandise Display System", the disclosure of which is hereby incorporated by reference and on which priority is hereby claimed.

BACKGROUND OF THE INVENTION

1. Field of the Invention

The present invention relates to merchandise display systems, and more specifically relates to merchandise display systems which are modular in function and which are free-standing or mountable to a wall.

2. Description of the Prior Art

Many conventional merchandise display systems include one or more parallel, vertically arranged, elongated support members which are spaced apart from one another. Each elongated support member may include a plurality of slots formed through its thickness and spaced apart axially along the length of the support member. The slots receive hooked ends of mounting brackets, which mounting brackets, when secured to the support members, extend perpendicularly to and outwardly from the front face of each support member. A tray or shelf extends between adjacent pairs of mounting brackets, and merchandise is displayed on, and supported by, the trays or shelves. The trays and shelves, with their associated mounting brackets, may be removed from their current location on adjacent support members and repositioned into different slots in the support members in accordance with the requirements of the merchandiser.

In order to reposition a shelf on such conventional merchandise display system, as described above, the shelf may have to be manipulated vertically (or horizontally) to disengage the mounting brackets on which the shelf rests from the elongated support members, and again manipulated vertically (or horizontally) to re-engage the mounting brackets to the support members when the shelf is repositioned. Such action, required to disengage the shelf and mounting brackets from the support members, may interfere with other shelves in close proximity to the shelf being repositioned and may necessitate the removal of other shelves adjacent to the one being repositioned. This problem is exacerbated if, rather than planar shelves or trays, rectangular parallelepiped or cuboidal modules situated one on top of another or situated side-by-side, with no space between modules, are used in the merchandise display system. Then, most probably all of the modules situated in a row or column may have to be removed in order to reposition a single module.

OBJECTS AND SUMMARY OF THE INVENTION

It is an object of the present invention to provide a merchandise display system which includes a quick release, front-loading mechanism for mounting individual shelves or modules used in the system.

It is another object of the present invention to provide a wall mountable, modular merchandise display system, where one module or a shelf of the display system may be easily removed without necessitating the removal of adjacent modules or shelves.

It is yet another object of the present invention to provide a wall mountable, merchandise display system having modules, trays or shelves which may easily lockingly engage or disengage from vertical support members of the system.

It is yet a further object of the present invention to provide a merchandise display system which overcomes the inherent disadvantages of conventional merchandise display systems.

A merchandise display system constructed in accordance with one form of the present invention includes a frame which is free-standing or which may be fixed to an existing wall in an establishment, and a plurality of modules which are mountable on the frame directly from the front of the frame without requiring any manipulation of the modules either vertically or horizontally. The modular merchandise display system incorporates a unique method of attaching the modules to the frame, and incorporates a quick disconnect mechanism that allows the merchandiser or store planners to easily re-planogram the items of merchandise in an efficient, cost-effective manner.

The merchandise display system includes a plurality of metal or plastic modular "cubes" that snap onto a steel back wall of the supporting frame. The frame further supports an indexing system having vertical members, preferably made from injection molded plastic, to allow the modules to locate into a specific position from the front of the support frame. Each of the individual modules has insertable, retractable product trays, which may be extended from and retracted into the modules, to accommodate varying types of merchandise. The trays may be removed from the module by the store owner.

One of the advantages of the merchandising display system of the present invention is that an individual module (or tray) may be easily detached from the front of the support frame utilizing a spring-activated "trigger" mechanism located beneath the tray front, or may be the actual tray front, and a molded header sign. The molded header sign works in concert with the tray front.

In order to disengage an individual module from the frame, the spring-loaded header, which is mounted on the module, is depressed in a backward direction toward the frame, which allows the store owner to pull the tray front forward. When the tray is in such an extended position, locking wings, which had engaged the indexing members mounted on the frame, are opened to disengage the indexing members so that the complete module may be repositioned on the frame in another location or replaced by another module containing different items of merchandise.

In accordance with another form of the present invention, a merchandise display system includes a support frame on which are mounted two or more vertically disposed, spaced apart indexing members. The merchandise display system also includes a plurality of modules. The modules are mountable on the frame and selectively engage the vertical indexing members. Each module includes one or more trays which are slidably mounted within the module and which may be extended outwardly from the module so that a customer may select an item of merchandise resting on the tray.

Extending outwardly from the rear of each module is a pair of spaced apart pins. The pins are closely received in arcuate open recesses, or bores, formed in adjacent vertical indexing members when the module is mounted on the frame. The module further includes a pair of mutually inwardly biased, pivotable locking wings. The locking wings selectively engage the vertical indexing members when the module is mounted thereon. A release member, forming part of a release mechanism, situated within each module may be pulled (or pushed) to disengage the locking wings from the vertical indexing members of the frame in order to remove a module from the front of the merchandise display system without the need to remove adjacent modules from the system.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
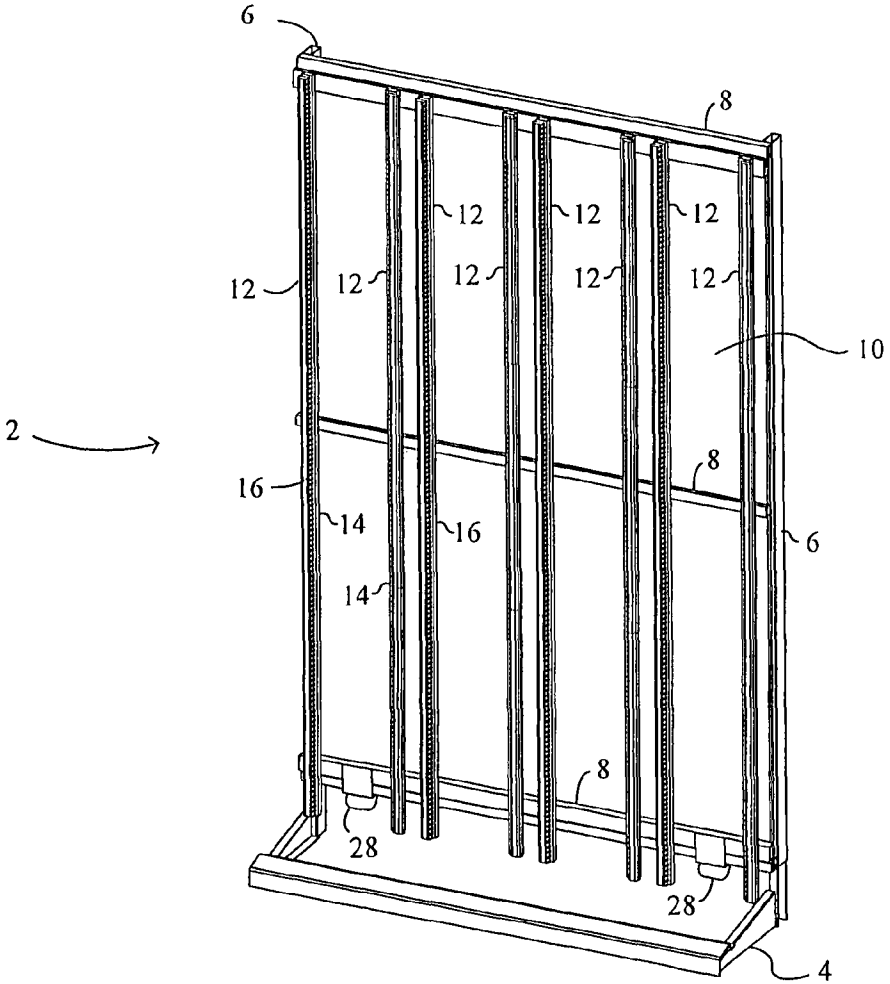
FIG. 1 is a front perspective view of a portion of a merchandise display system constructed in accordance with one form of the present invention.
Figure 2:
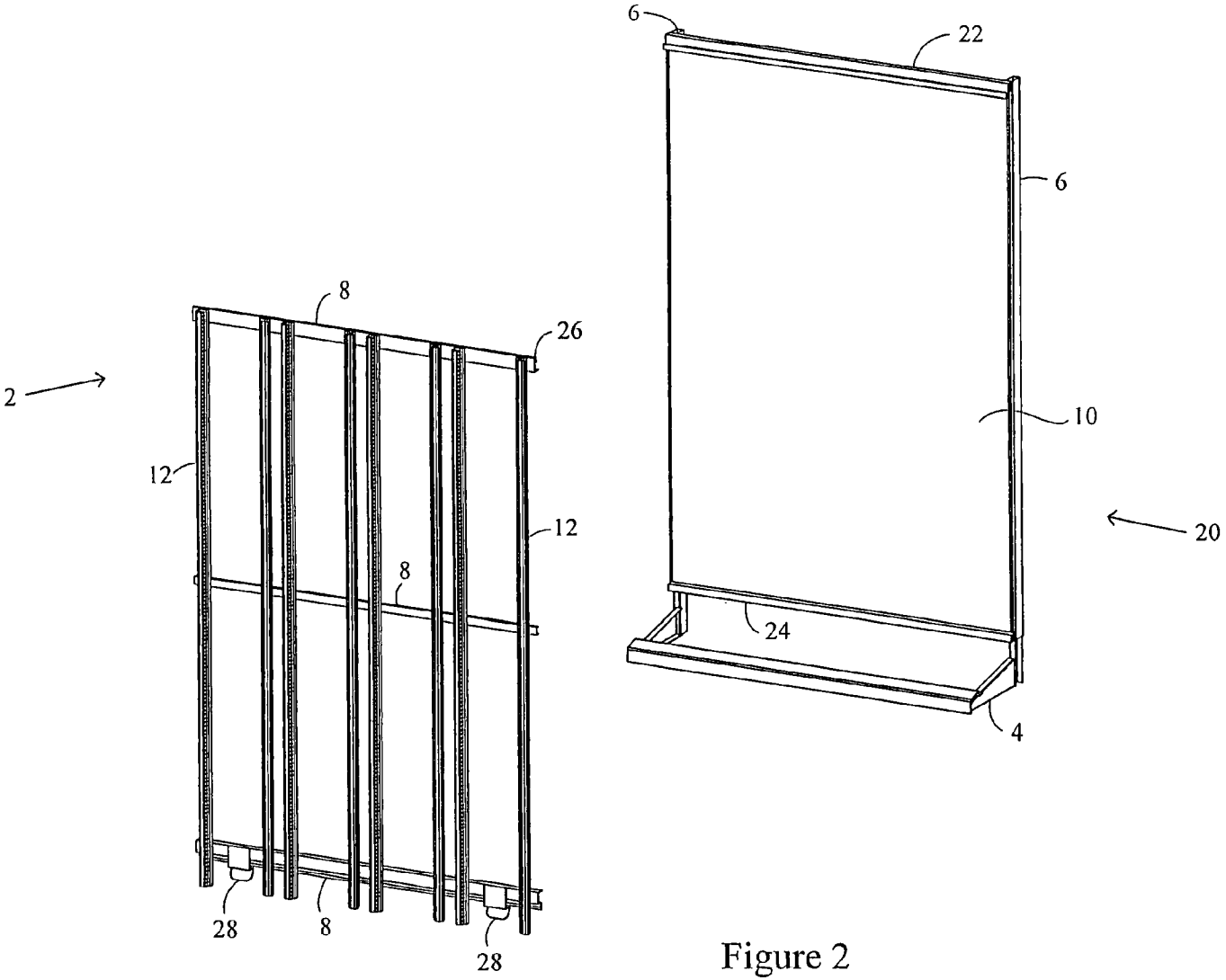
FIG. 2 is an exploded, front perspective view of the portion of the merchandise display system of the present invention shown in FIG. 1.
Figure 3:
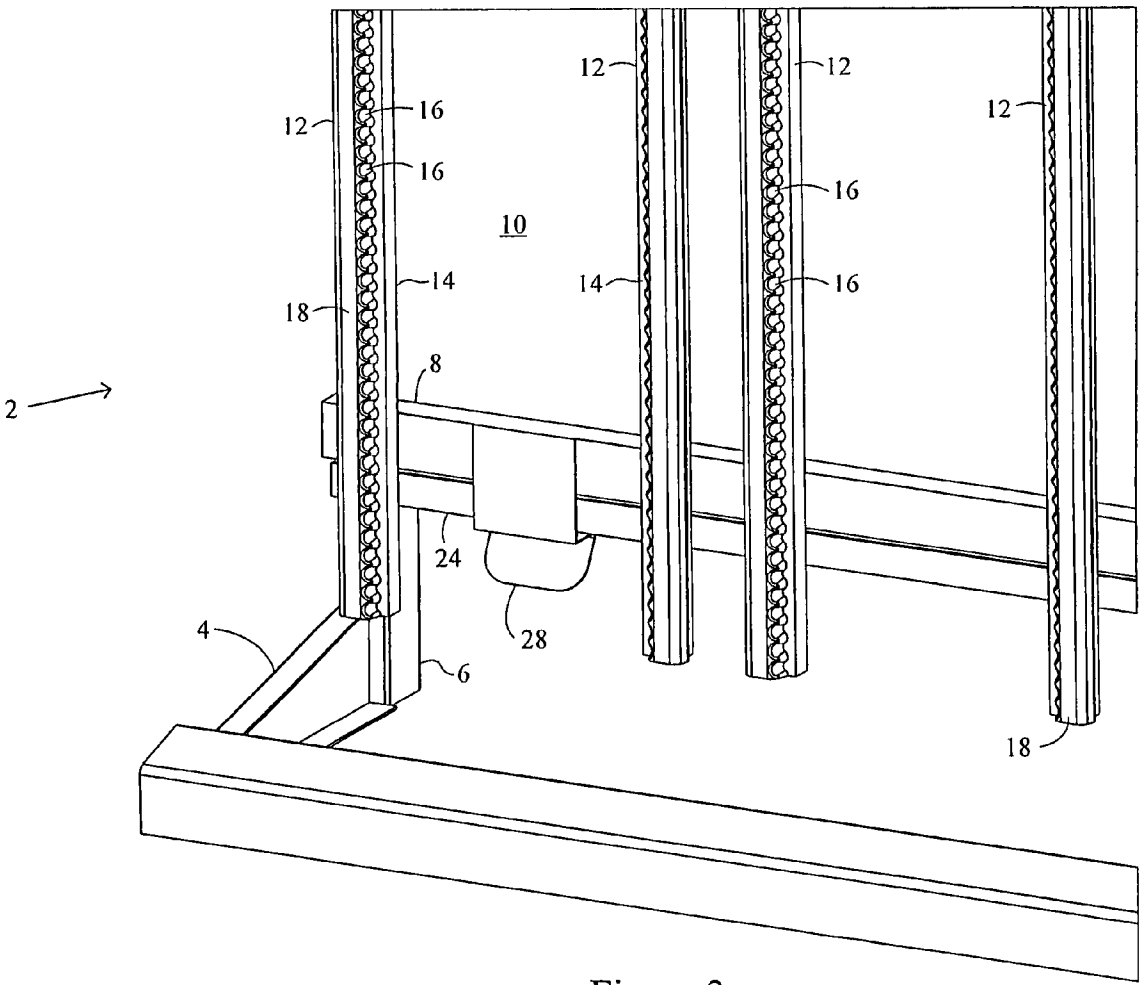
FIG. 3 is an enlarged front perspective view of a portion of the merchandise display system of the present invention shown in FIGS. 1 and 2.
Figure 4:
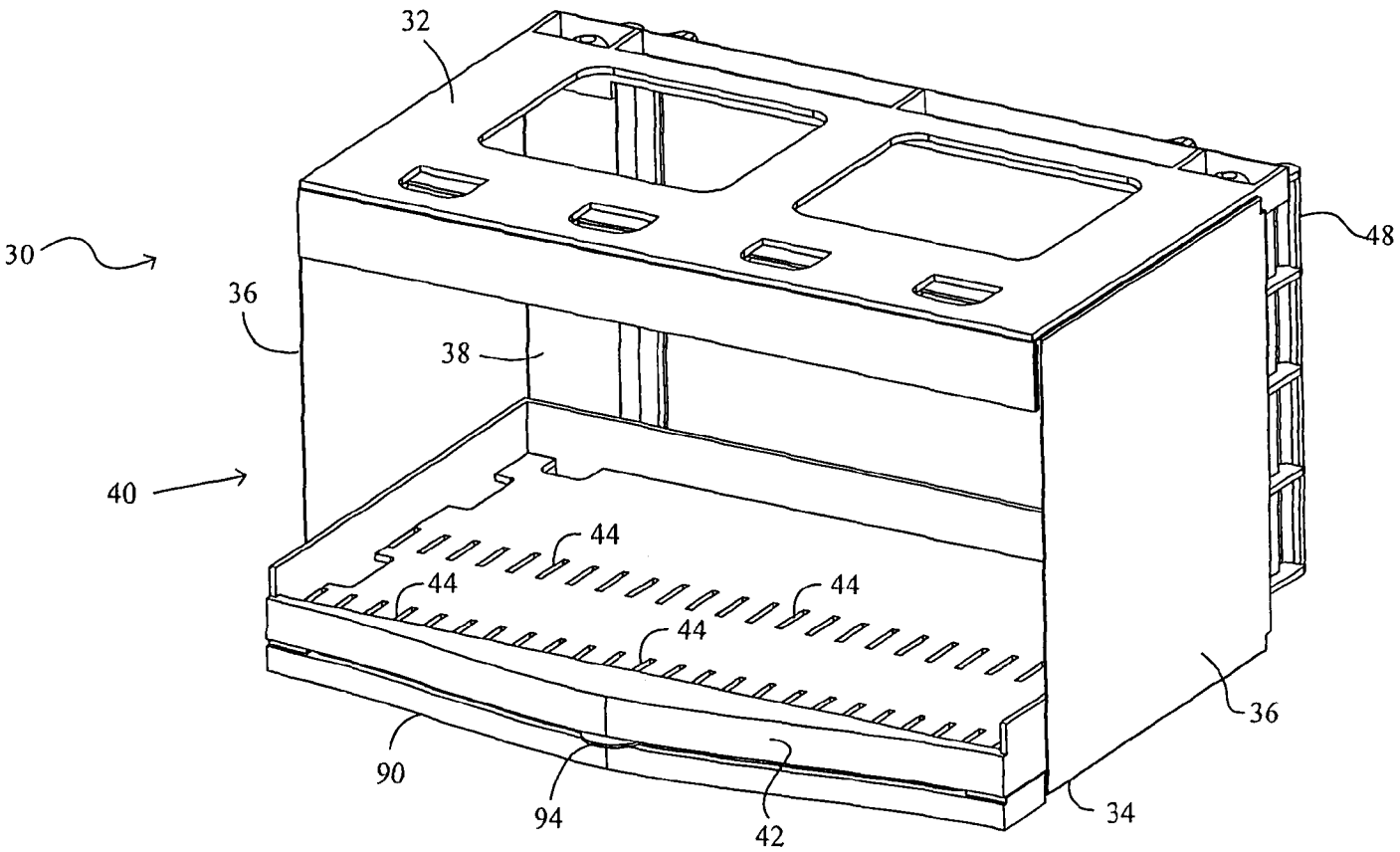
FIG. 4 is a front perspective view of a merchandise display module constructed in accordance with the present invention for use with the merchandise display system of the present invention.
Figure 5:
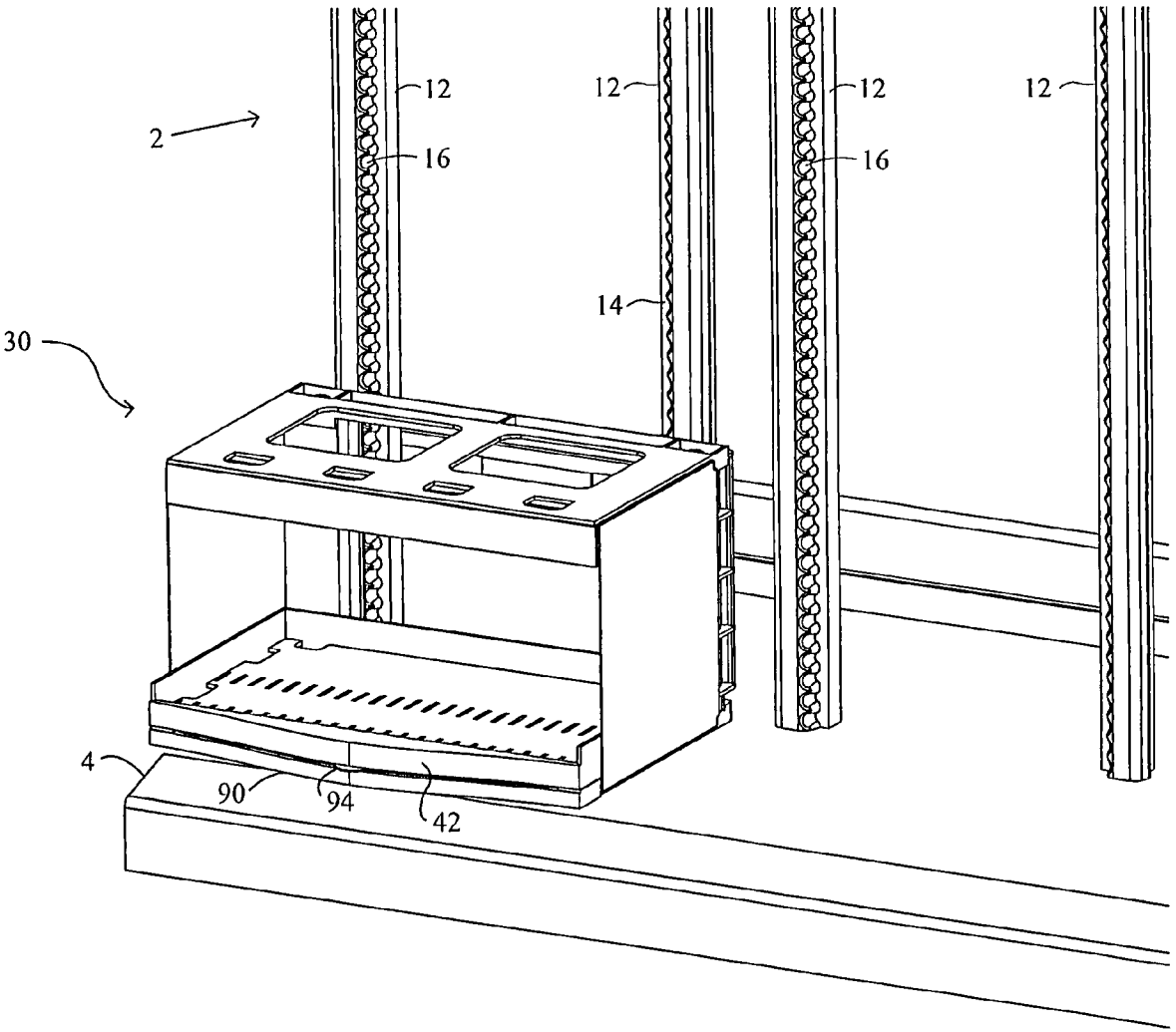
FIG. 5 is a front perspective view of the module shown in FIG. 4 mounted on vertical indexing members forming part of the merchandise display system of the present invention.
Figure 6:
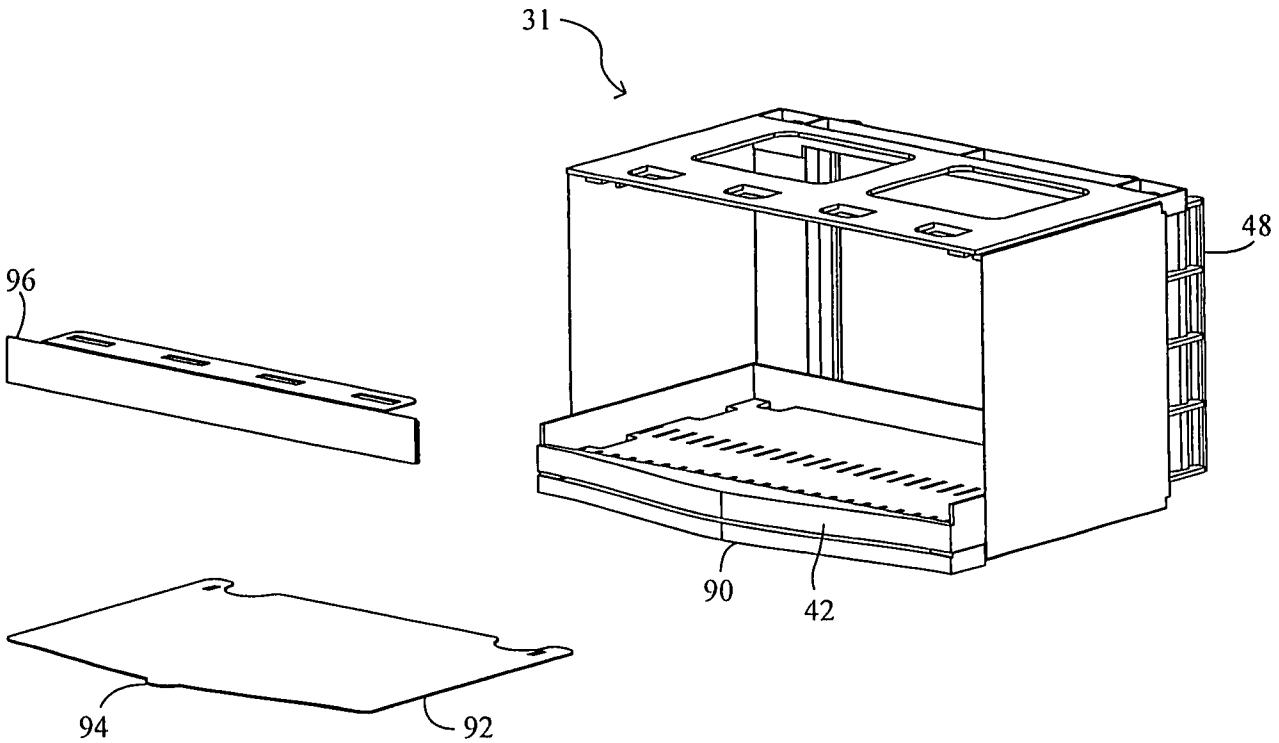
FIG. 6 is a partially exploded, front perspective view of the module of the present invention shown in FIGS. 4 and 5 for use with the merchandise display system of the present invention.

Referring initially to FIGS. 1-3 of the drawings, it will be seen that a modular merchandise display system, constructed in accordance with one form of the present invention, includes a frame 2 made of steel or other structural material. The frame 2 includes a base 4 which rests on the floor of an establishment, vertical side pieces 6 attached to the base 4 and horizontal cross braces 8 attached to the vertical side pieces 6. The frame 2 further includes a back wall 10, formed of steel or other material, which is joined to the vertical side pieces 6 and horizontal cross braces 8. The frame 2 may be free-standing on its base 4, or may be situated adjacent to a wall or other vertical supporting structure and attached thereto by fasteners or the like for added safety.

A plurality of pairs of vertically disposed indexing members 12 is mounted on the front face of the frame 2 to the horizontal cross braces 8. The pairs of indexing members 12 are spaced apart adjacent one another, and the indexing members 12 of each pair are also spaced apart from each other a predetermined distance.

Each vertical indexing member 12 is an elongated piece having opposite lateral sides 14. The lateral sides 14 of a pair of indexing members 12 which face each other have formed therein a plurality of partial cylindrical or arcuate cuts or open recesses 16 formed adjacent to one another along the longitudinal length thereof. Thus, a particular arcuate recess 16 formed in one indexing member 12 of a respective pair of indexing members is in alignment with and faces an arcuate recess 16 formed in an adjacent indexing member 12 of the same pair of indexing members. Alternatively, each indexing member 12 may include bores (not shown), instead of arcuate recesses 16, formed in the front face 18 thereof and extending at least partially through the thickness thereof. The indexing members 12 may be formed from an injection-molded plastic, metal or other material.

Although the frame 2 of the merchandise display system is described as including a base 4, back wall 10, vertical side pieces 6 and horizontal cross braces 8, the system may be designed to cooperate with a pre-existing display frame 20 comprising the base 4, back wall 10 (such as a peg board backing) and vertical side pieces 6, as well as upper and lower horizontal support members 22, 24, as shown in FIG. 2. The frame 2 of the present system, then, would include several horizontal cross braces 8 on which are mounted the vertical indexing members 12. The top horizontal cross brace 8 may include a hook 26 running along the axial length thereof which engages the upper horizontal support member 22 of the pre-existing display frame 20, and the bottom horizontal cross brace 8 would be affixed to the lower horizontal support member 24 using resilient clips 28, as shown in FIGS. 2 and 3.

In one form of the present invention, and as shown in FIGS. 4-13 of the drawings, the merchandise display system includes a plurality of modules 30. Each module 30 is preferably in the shape of a rectangular parallelepiped or cuboid, that is, being box-like in shape. More specifically, each module 30 has a box-like main portion 31 which includes a top wall 32, a bottom wall 34, opposite lateral side walls 36 and, optionally, a rear wall or partial rear wall 38, to define at least a four-sided enclosure having a front opening 40. The module 30 may include one or more retractable trays 42 mounted therein. The trays 42 within the module 30 are provided for supporting merchandise thereon. The trays 42 may include slots 44 formed therein to receive dividers (see FIG. 31) for partitioning items of merchandise. Each tray 44 is preferably slidably mounted to the lateral side walls 36 of the module 30 using conventional drawer slide mechanisms (not shown), and may be extended at least partially outwardly through the front opening 40 thereof so that a customer may easily select an item of merchandise displayed within the module 30 and supported on the tray 42. The tray 42 is retractable within the module 30 through the front opening 40 thereof. The tray 42 is preferably formed from an injection-molded plastic, but may be formed of sheet metal or other material.

Each module 30 of the plurality of modules may include one pair, or more than one pair, of locator pins 46 extending outwardly from the rear side of the module 30. Each pin is preferably situated near an opposite lateral side wall 36 of the module 30, and the pins 46 are spaced apart from one another a predetermined distance. Adjacent vertically disposed, indexing members 12 are also spaced apart from each other a predetermined distance so that the pins 46 may register with and be at least partially closely received by the arcuate recesses 16 facing one another formed in adjacent indexing members 12 of a respective pair of indexing members. Thus, the modules 30 of the merchandise display system of the present invention may be loaded into the display system perpendicularly directly from the front of the frame 2, where the rearwardly facing pins 46 of each module 30 engage corresponding arcuate recesses 16 formed in adjacent spaced apart indexing members 12 of the frame 2. No manipulation of the module 30 either horizontally or vertically is required to reposition the module in a different location on the frame 2 and, accordingly, the modules 30 of the merchandise display system may be spaced closely to one another both vertically and horizontally and yet may be easily removed from and repositioned on the support frame 2.

To ensure that each module 30 lockingly engages the indexing members 12 of the frame 2, each module 30 includes at least one pair of pivotable locking wings 48. Each locking wing 48 is pivotably mounted to the module 30 on the rear side thereof, and extends rearwardly on each module. Each locking wing 48 is structured to define a recess or pocket 50 on a lateral side thereof. More specifically, the recess 50 of one locking wing 48 of a respective module 30 is formed so that it faces the recess 50 of the other locking wing 48 of the same module 30 and so that one locking wing 48 is structured as the mirror image of the other locking wing 48.

The locking wings 48 of each module 30 are biased by springs 52 or other means towards each other so that they extend substantially parallel to one another rearwardly of the module 30 on which they are mounted, but are pivotable laterally outwardly, away from each other, when the module 30 is being mounted onto adjacent indexing members 12 of a respective pair of indexing members. Each locking wing 48 includes a free end 54 having a leading, laterally outwardly sloping camming surface 56 situated adjacent to and outwardly from the recess or pocket 50 formed in the locking wing 48.

When a module 30 is being mounted on the frame 2, the spaced apart pins 46 of the module 30 are aligned with corresponding arcuate recesses 16 (or bores) formed in the indexing members 12, and the module 30 is pushed toward the front face of the frame 2, with the pins 46 registering with certain arcuate recesses 16 of the indexing members 12. The non-facing, opposite lateral sides 14 of the indexing members 12 contact the camming surfaces 56 of the locking wings 48, spreading the locking wings apart from one another against the bias of the springs 52. As the module 30 is continued to be pushed into the frame 2, the indexing members 12 move past the camming surfaces 56 of the locking wings 48 and are securely received by the pockets or recesses 50 formed therein. The locking wings 48, which are biased in a direction towards one another, close about the pair of indexing members 12 so that the locking wings 48 partially surround portions of the non-facing lateral sides 14 of the indexing members 12. With the pins 46 registered with selected arcuate recesses 16 of the indexing members 12 and the locking wings 48 closely engaging the lateral sides 14 of the indexing members, the product module 30 is now securely mounted to the frame 2 of the merchandise display system.

Each module 30 includes a release mechanism to allow the store owner to remove a module from the frame 2 of the merchandise display system. As can be seen from FIG. 11 of the drawings, the release mechanism includes an elongated release bar 58 which is mounted above the bottom wall 34 of the module 30 and below a plate-like frame 60 which, in turn, is situated below the lowest merchandise tray 42 in the module. The module frame 60 defines a tunnel 62 with the bottom wall 34 of the module 30 in which the release bar 58 may reciprocatingly slide. As can be seen from FIG. 11, each spring 52 for biasing the locking wings 48 is secured at one end to the top surface of the module frame 60 and at its other end to an extended portion 64 of the locking wing 48 which is situated internally to the module 30 and on the opposite side of a pivot pin (not shown) by which each locking wing 48 is pivotally mounted on the module frame 60. Thus, the release bar 58 reciprocatingly slides in the tunnel 62 of the module frame 60, and has an exposed axial end 66 which extends beyond the front opening 40 of the module 30. The exposed axial end 66 of the release bar 58 includes a tab 68 or opening 70 formed through its thickness which may be easily grasped by the store owner to remove a module 30 from the frame 2.

The inner axial end 72 of the release bar 58, situated opposite the exposed end 66, includes a pair of spaced apart pins 74 extending upwardly from the upper surface of the release bar 58. Each pin 74 is received by an elongated slot 76 formed in one end 78 of each of a pair of angled lever arms 80. Each lever arm 80 includes a first segment 82 and a second segment 84 which is joined to the first segment 82 and disposed at an angle thereto. The opposite axial end 86 of each lever arm 80 is pivotally joined to the inwardly extending portion 64 of a respective locking wing 48. Each lever arm 80 is pivotally mounted to the module frame 60 by a pivot pin 88 situated near where the first segment 82 is joined to the second segment 84.

To remove a selected module 30 from the frame 2 of the merchandise display system, the store owner pulls outwardly, away from the front opening 40 of the module 30, on the exposed end 66 of the release bar 58. When the store owner pulls on the release bar 58, the lever arms 80 pivot to force the locking wings 48 to open and disengage from a respective indexing member 12 against the bias of the spring 52 of each locking wing. The store owner may remove a module 30 from the frame 2 perpendicularly and outwardly from the front face of the frame 2. The store owner pulls on the module 30 until the pins 46 disengage from the arcuate recesses 16 formed in the adjacent indexing members 12 of the respective pair of indexing members on which the module 30 is mounted. The module release mechanism, including the elongated release bar 58 and pivotable lever arms 80, is contained substantially entirely within the module 30 and does not interfere with the closely spaced, adjacent modules 30 mounted on the frame 2.

Figure 7:
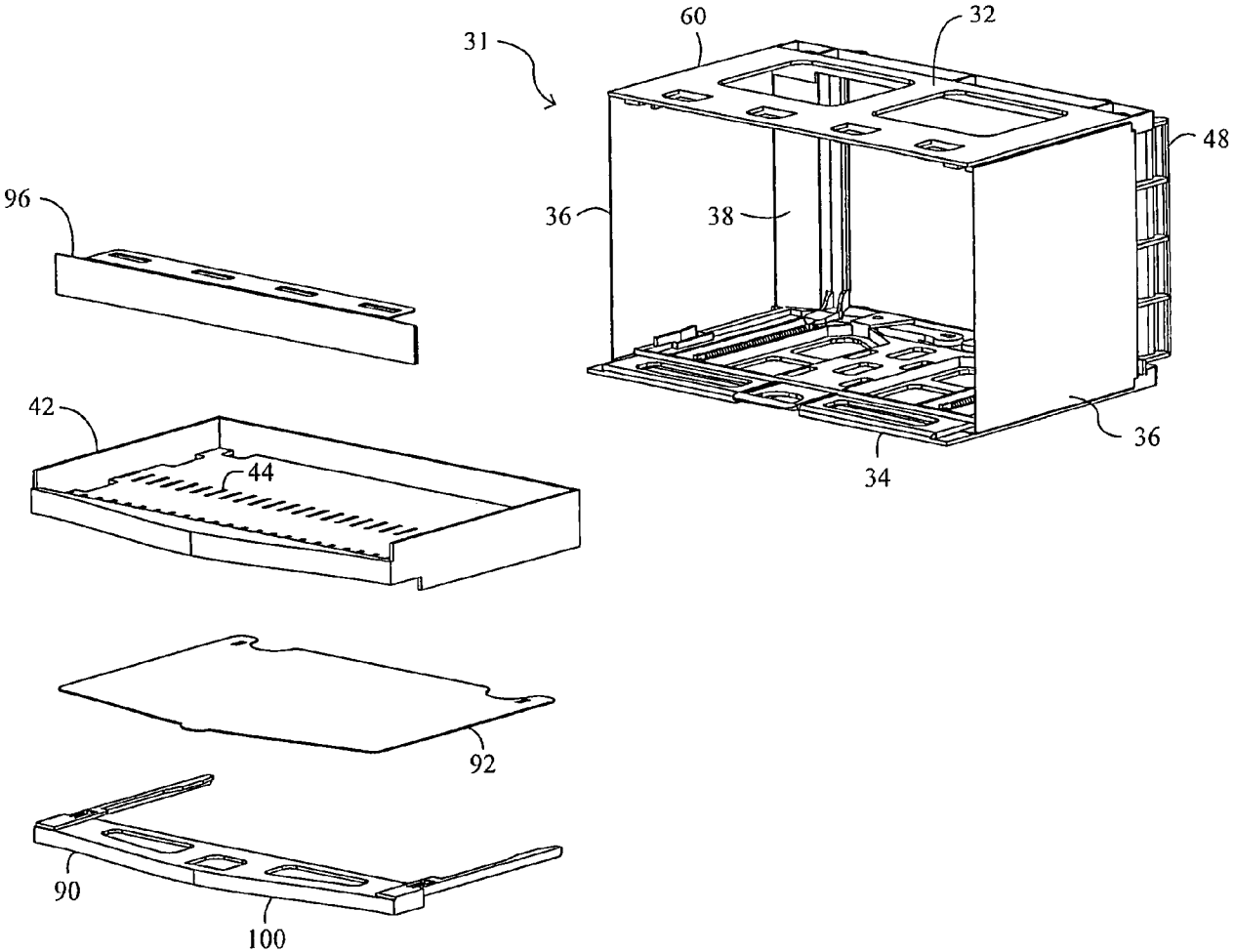
FIG. 7 is a partially exploded, front perspective view of a tray portion of the module of the present invention shown in FIG. 4.
Figure 8:
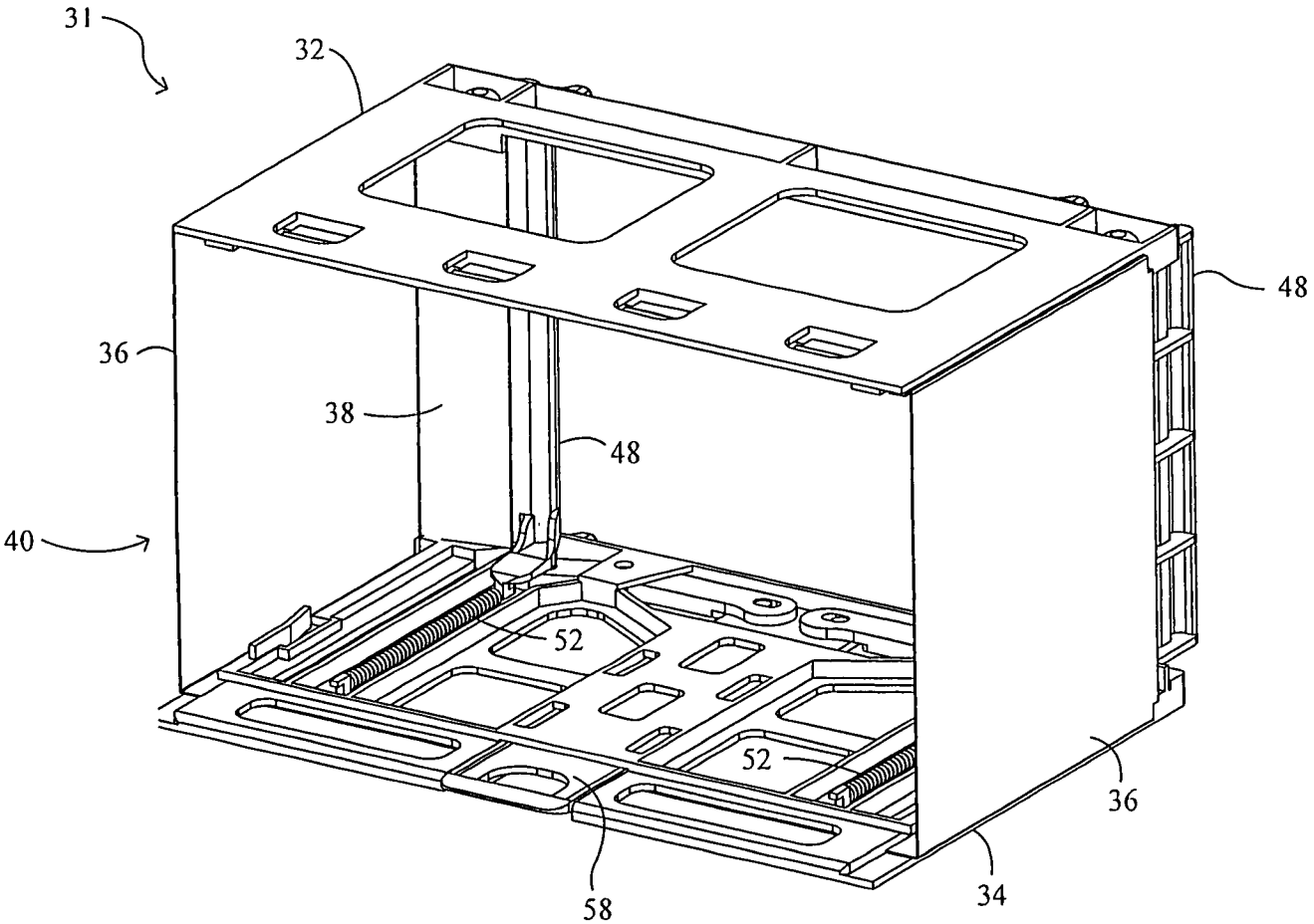
FIG. 8 is a front perspective view of a main portion of the module constructed in accordance with the present invention for use with the merchandise display system of the present invention.
Figure 9:
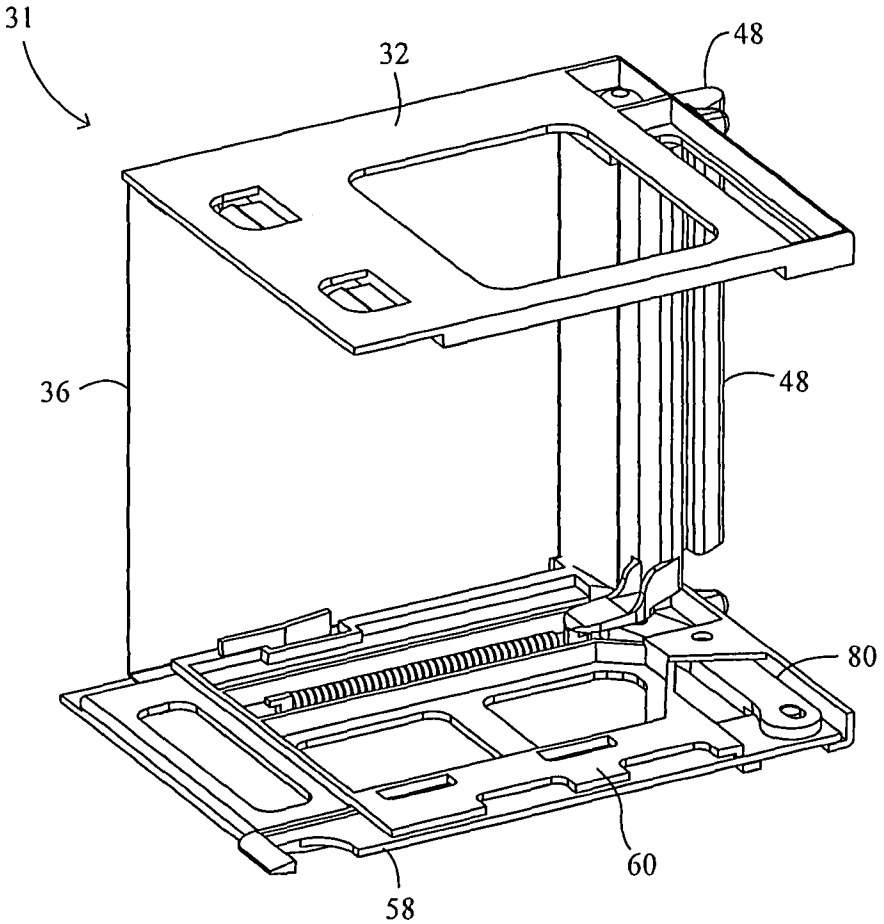
FIG. 9 is a cut away, front perspective view of the main portion of the module of the present invention shown in FIG. 8.
Figure 10:
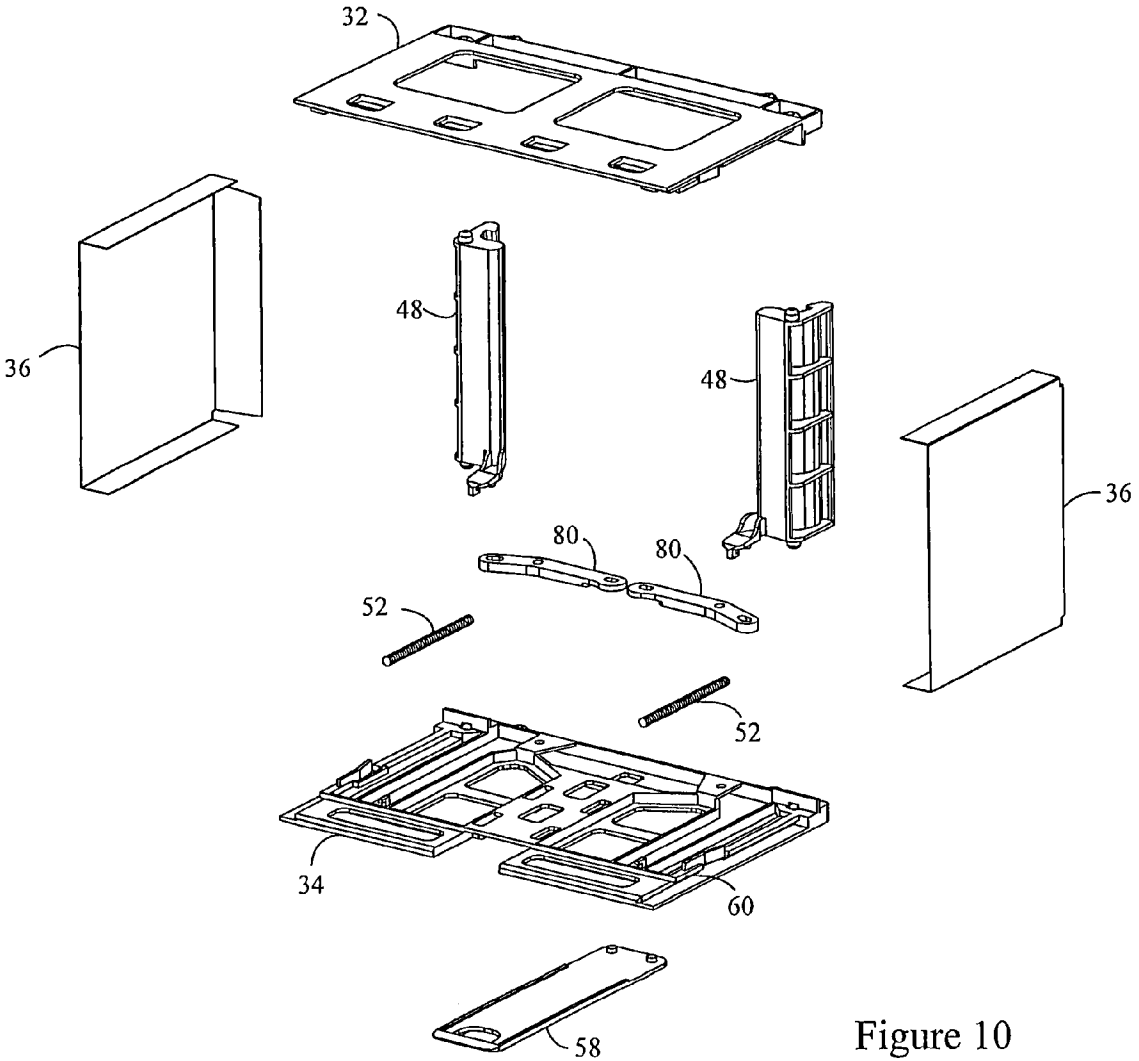
FIG. 10 is an exploded, front perspective view of the main portion of the module of the present invention shown in FIG. 8.
Figure 11:
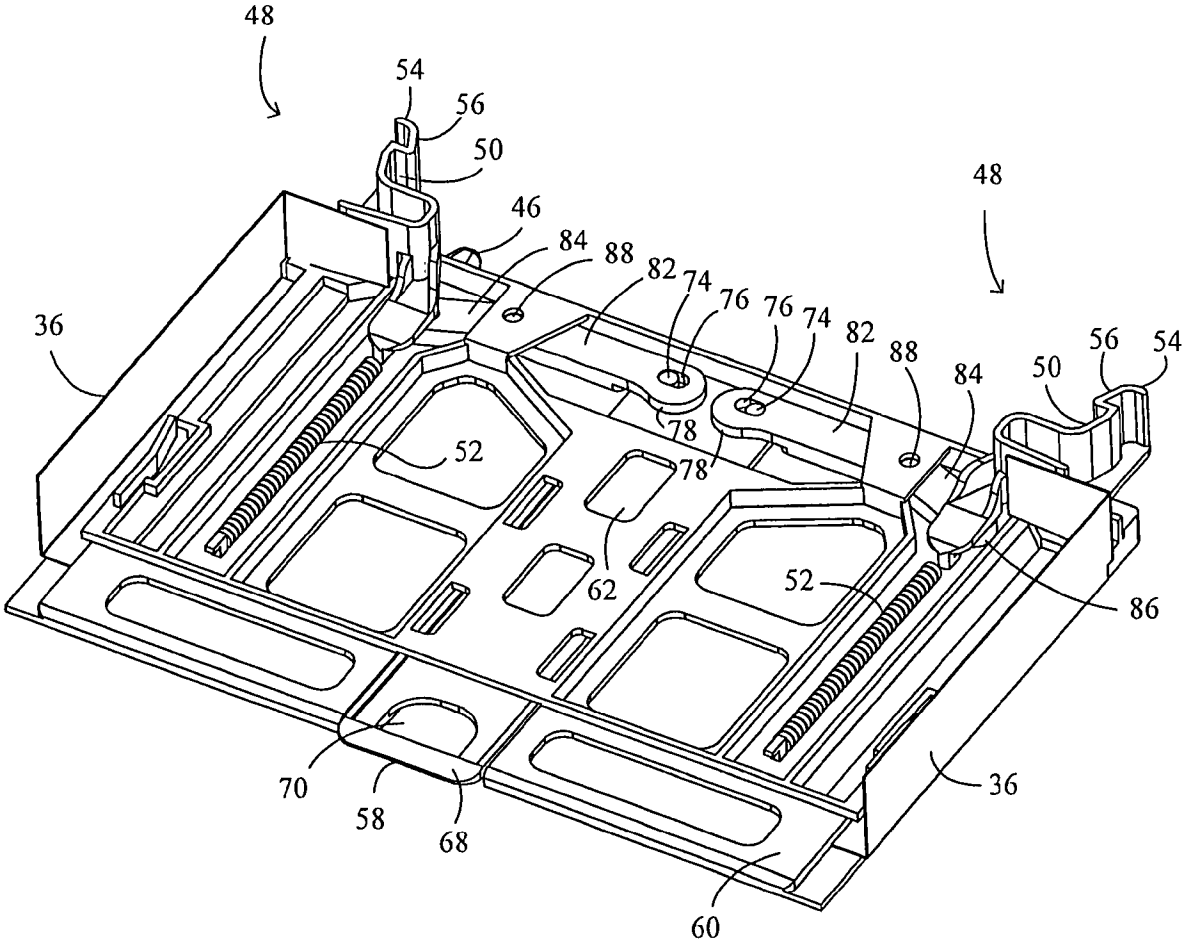
FIG. 11 is a top perspective view of the lower portion of the module of the present invention and illustrating the release and latching mechanisms thereof.
Figure 12:
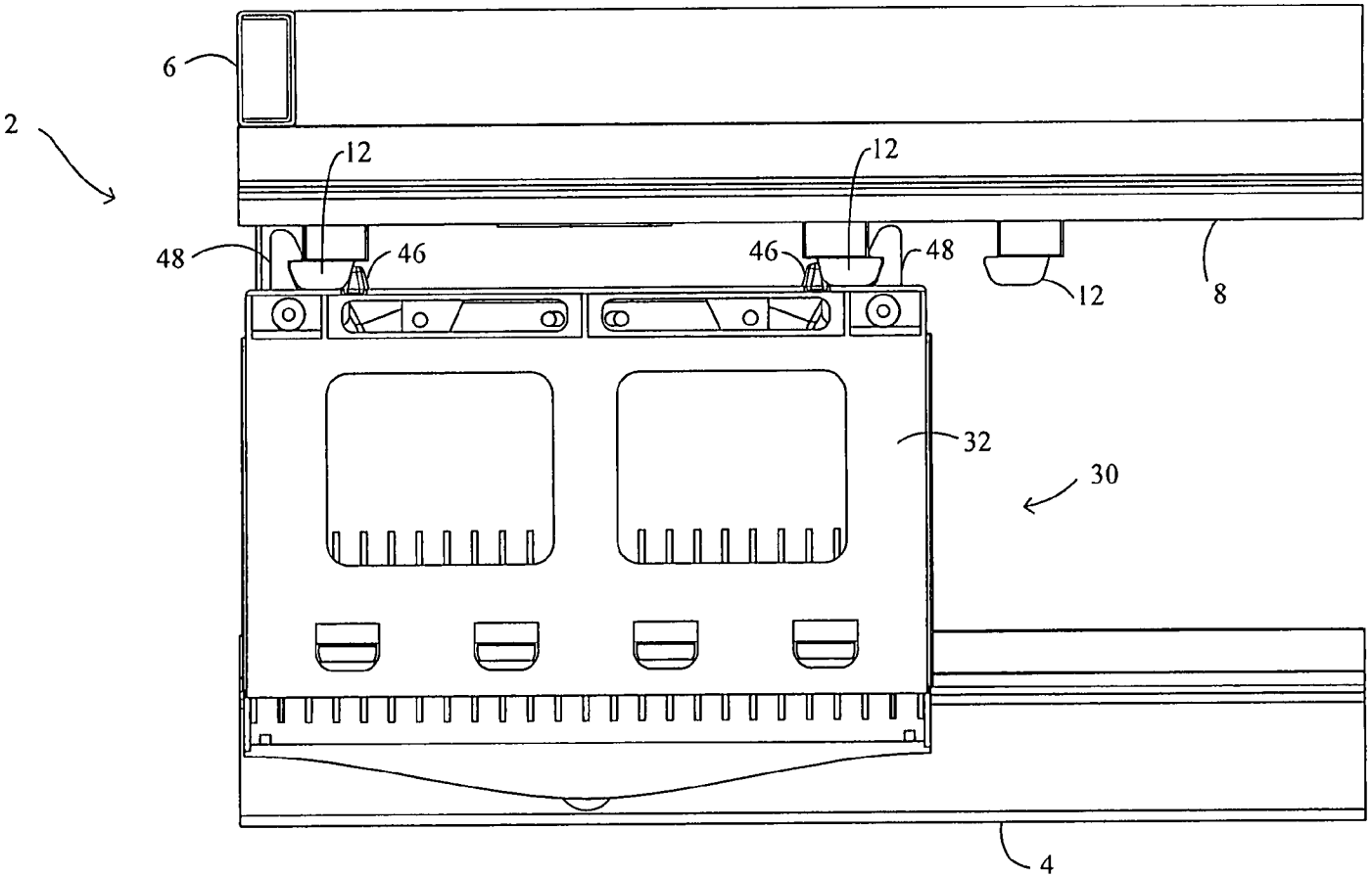
FIG. 12 is a top plan view of the module of the present invention shown in FIG. 4, and illustrating its attachment to a support frame forming part of the merchandise display system of the present invention.
Figure 13:
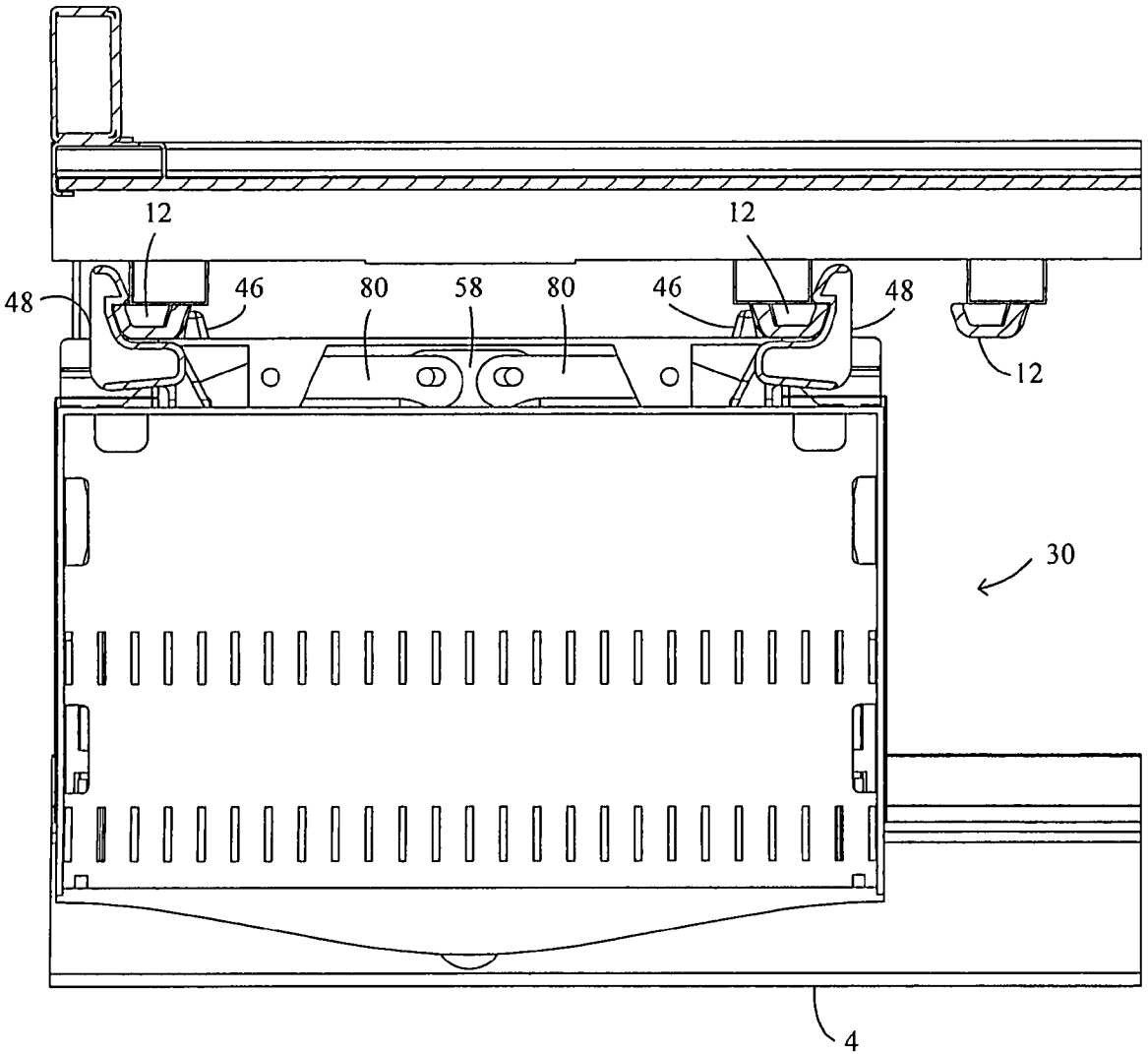
FIG. 13 is a top plan view of a portion of the module of the present invention shown in FIG. 12, with the top portion thereof cut away to facilitate an understanding of the invention.

In an alternative version of the module 30, as shown in FIG. 7, the module includes a UPC panel 90 and panel cover 92 situated underneath the merchandise tray 42. The UPC panel 90 and panel cover 92 are operatively joined to the release bar 58. The store owner may pull on a tab 94 of the panel cover 92 extending outwardly from the front of the UPC panel 90 and tray 42, which causes the UPC panel 90 and the release bar 58 affixed thereto to move outwardly of the module 30, thereby releasing the locking wings 48 from their engagement with respective indexing members 12 of the frame 2, in order to remove a particular module 30 from the frame 2.

Figure 14:
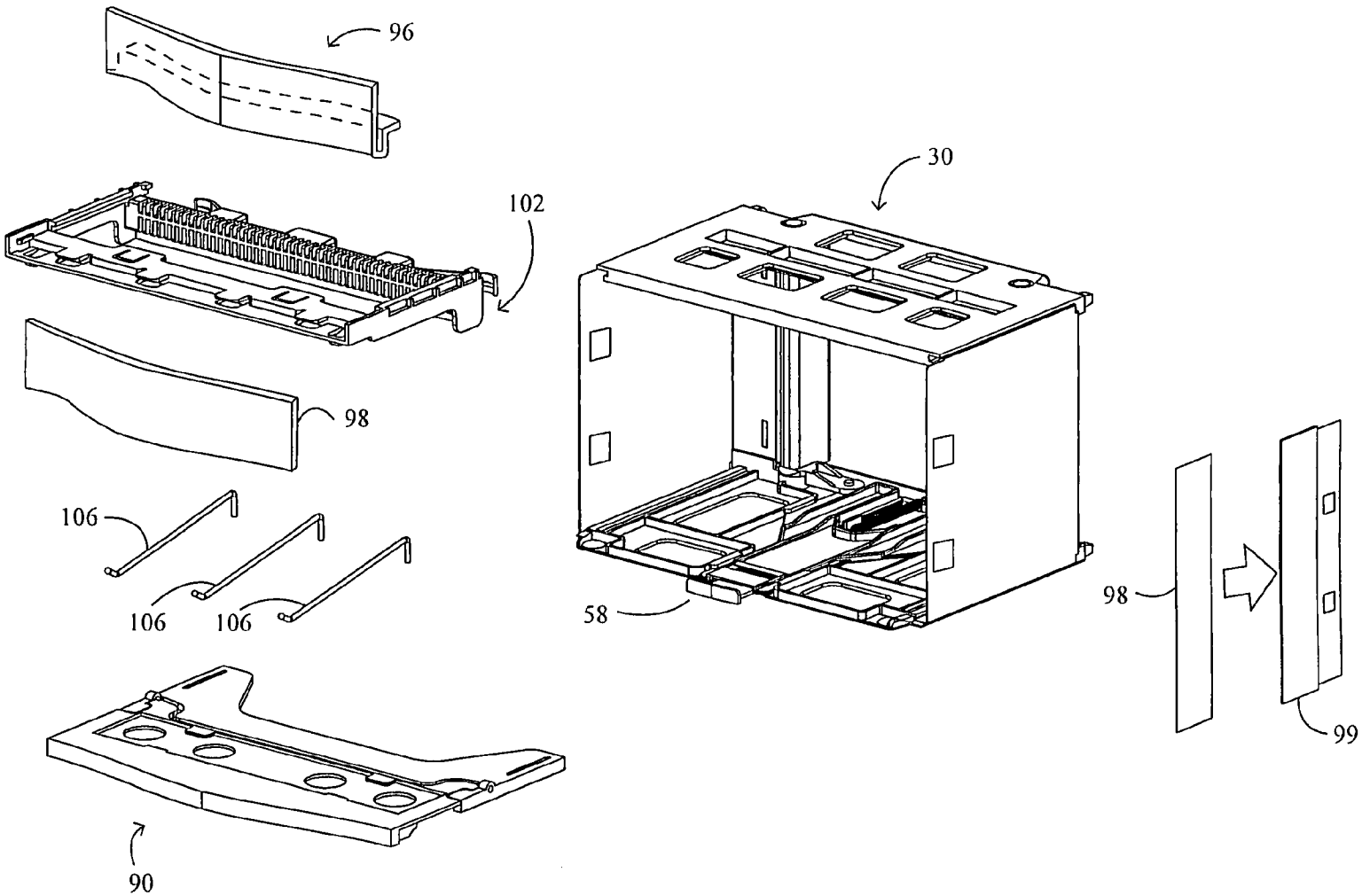
FIG. 14 is an exploded, front perspective view of another form of a module for use with the merchandise display system of the present invention.
Figure 15:
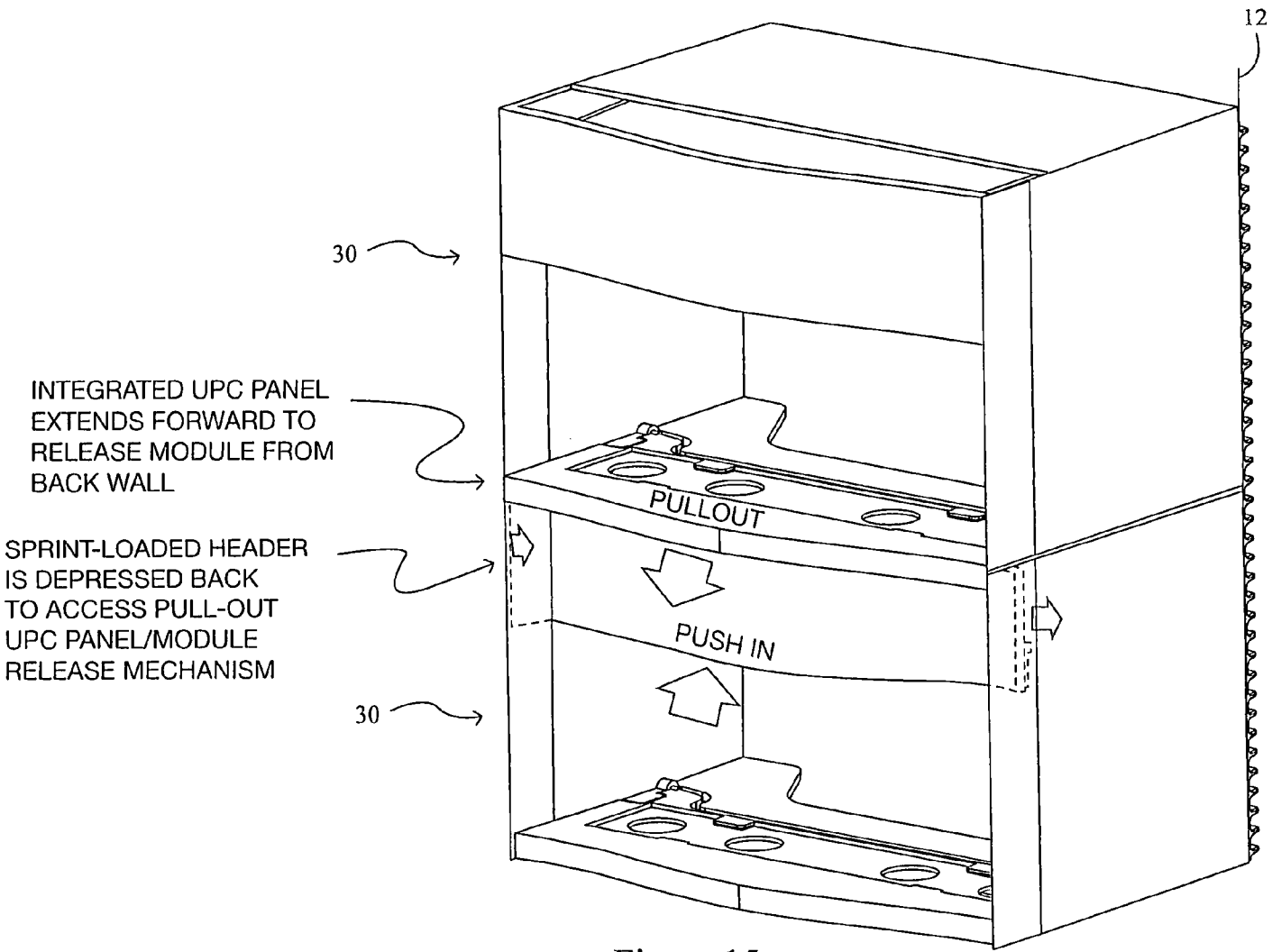
FIG. 15 is a front perspective view showing a pair of modules and the operation of the release mechanism to remove a module from the merchandise display system of the present invention.

A further modification of the module 30 is shown in FIGS. 14 and 15. A resilient header piece 96 is mounted to the module 30 at the upper front portion thereof. At least a portion of the header piece 96 is made of a transparent material so that the store owner may display product information or other graphics on a sheet of material 98 situated behind the header piece 96 and viewable through it from the front of the module 30. A graphics panel 98 may also be received behind and held in place by a clear or transparent side graphics holder piece 99 removably affixed to opposite side walls 36 of the module. The header piece 96, because of its resiliency, may be deflected inwardly of the module 30 by the store owner to expose the underside of the UPC panel 90 of the module 30 situated directly above it. In this way, the store owner may insert his fingers behind the underside and downwardly protruding front lip 100 of the UPC panel 90 of the module 30 situated directly above the module having the header piece 96 he is deflecting so that he may pull outwardly on the UPC panel 90 in order to move the release bar 58 and disengage the module 30 from the support frame 2.

It should be further noted from FIGS. 14 and 15 that the module 30 includes a hook bar 102 situated near the top wall 32 thereof. The hook bar 102 includes a plurality of recesses 104 formed across the width thereof. One or more product hooks 106, having downwardly bent rear end portions 108 which are receivable in corresponding hook bar recesses 104 selected by the store owner, may be positioned within the module 30, with the opposite upwardly bent free ends 110 of the product hooks 106 extending toward the front opening 40 of the module. Merchandise may be displayed within the module 30 by being inserted over the free ends 110 of the hooks 106 and hung thereon for selection and removal therefrom by consumers.

Figure 16:
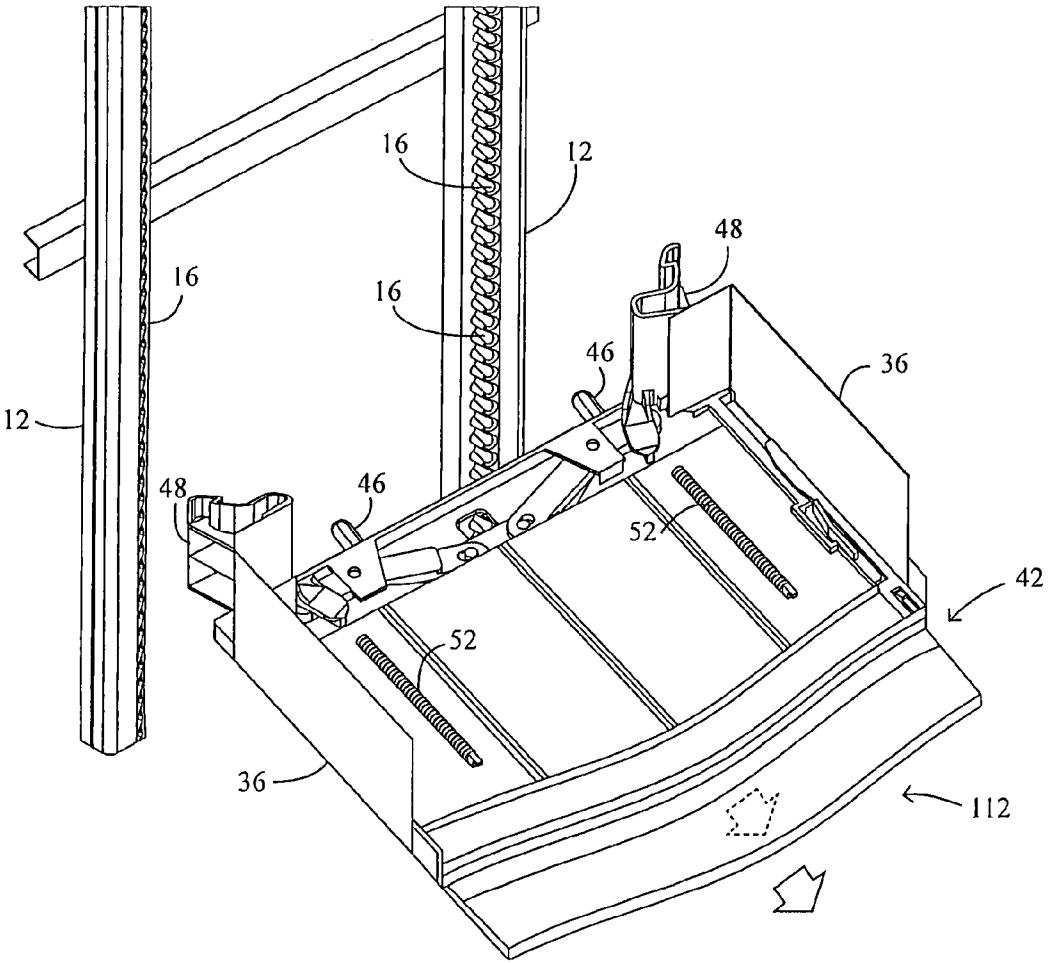
FIG. 16 is a front perspective view of a merchandise display system constructed in accordance with another form of the present invention, and illustrating a module and vertical indexing members of the merchandise display system and how the module is mountable to the vertical indexing members.
Figure 17:
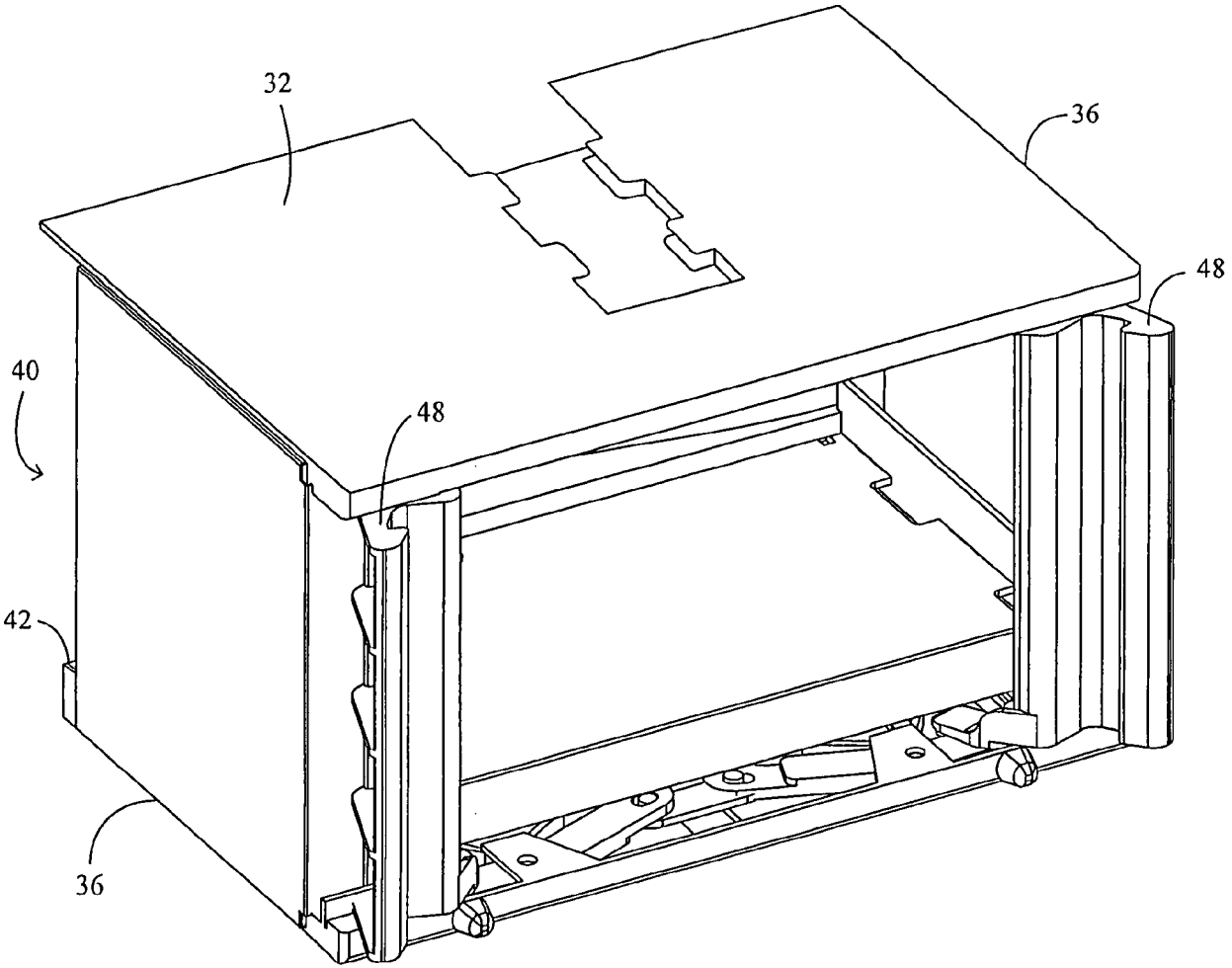
FIG. 17 is a rear perspective view of the module of the present invention shown in FIG. 16.

FIGS. 16 and 17 illustrate another version of the modular merchandise display system of the present invention. In the cutaway view of the module 30 shown in FIG. 16, the tray 42 situated within the module 30 is designed to accept pusher modules (see FIG. 29) which are spring loaded and exert pressure on a row of merchandise items standing upright in each pusher module, pushing the merchandise items towards the front of the pusher module and the tray 42. An example of such pusher modules is shown in U.S. Pat. No. 6,105,791 (Chalson, et al.), the disclosure of which is incorporated herein by reference. A spring-loaded extendible and retractable front UPC panel 112, similar to the UPC panel 90, situated below the tray 42, is operatively linked to the locking wings 48, such as by being coupled to the release bar 58, to disengage the locking wings 48 from the indexing members 12 by pulling outwardly thereon in much the same way as the release bar 58 and release mechanism of the prior embodiments shown in FIGS. 1-15 operate.

FIGS. 18-42 illustrate a preferred form of a modular merchandise display system constructed in accordance with the present invention. The preferred form of the display system shown in these figures is similar in structure and function to the embodiments described previously and shown in FIGS. 1-17.

Figure 18:
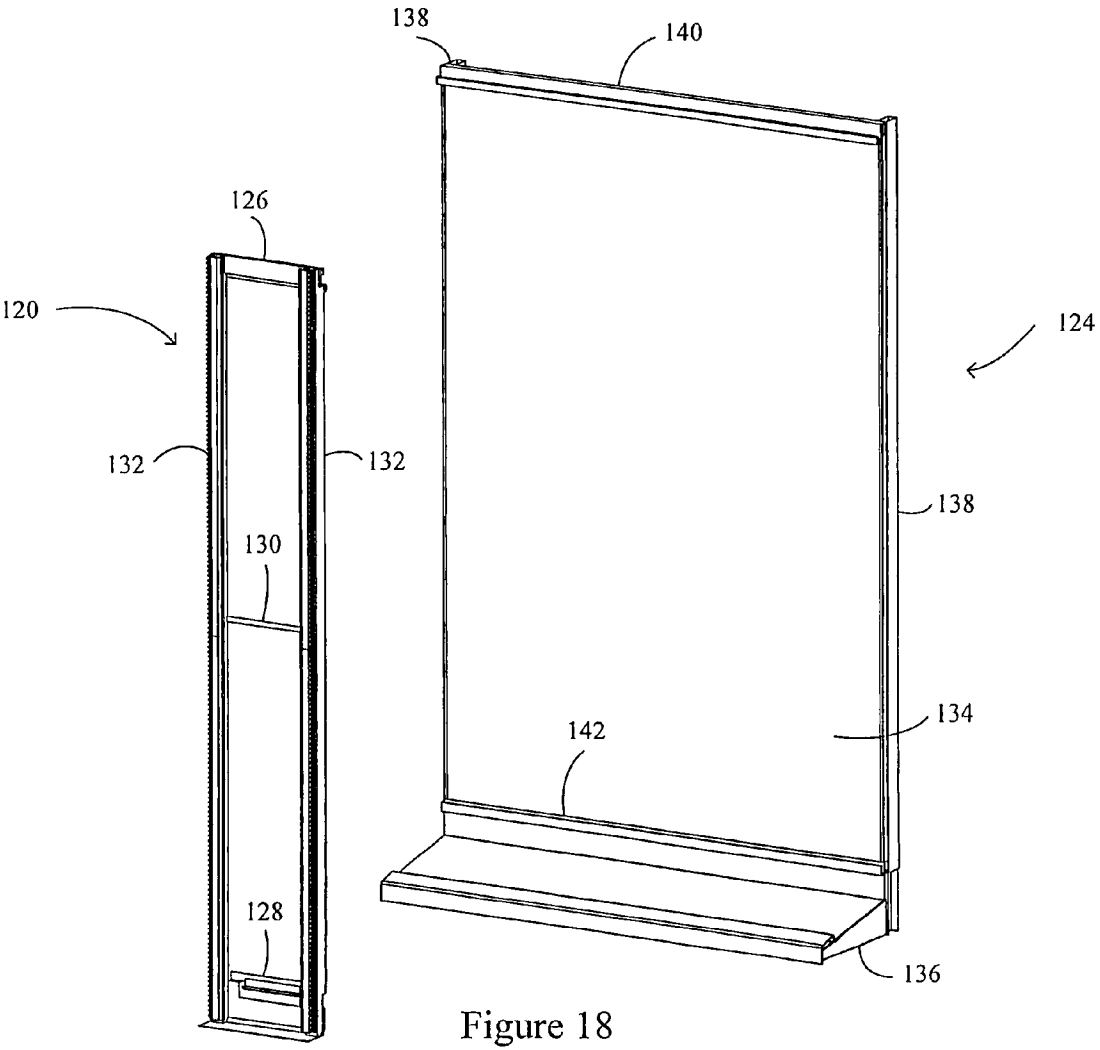
FIG. 18 is an exploded, front perspective view of a portion of a merchandise display system constructed in accordance with another form of the present invention.
Figure 19:
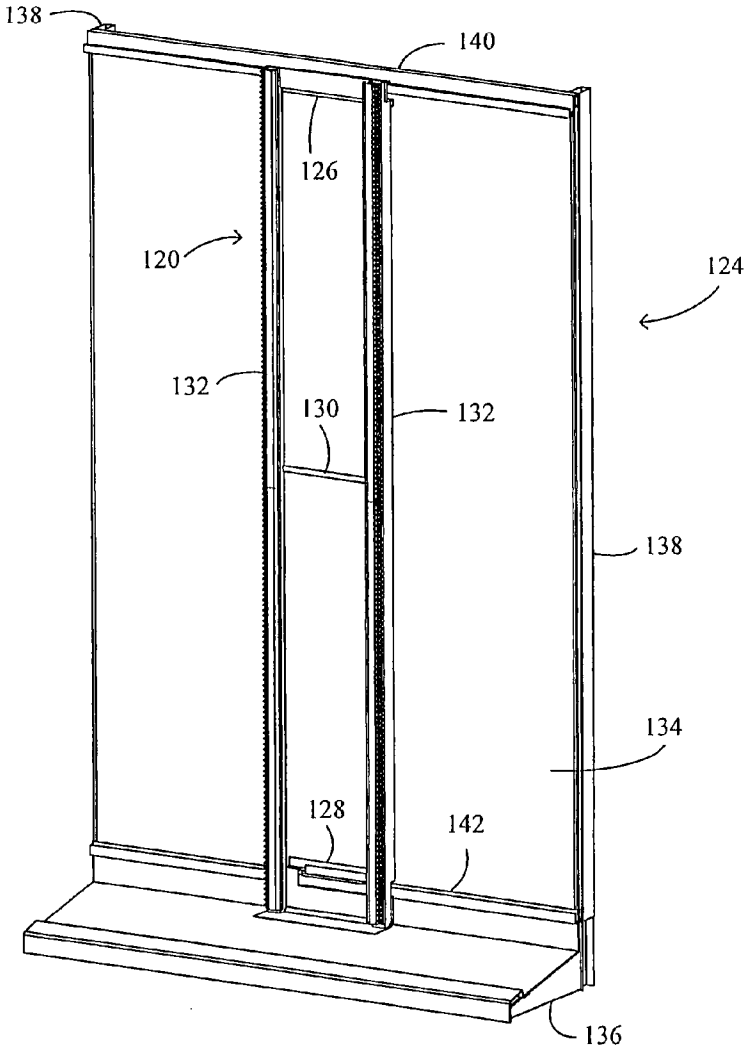
FIG. 19 is a front perspective view of the portion of the merchandise display system of the present invention shown in FIG. 18.
Figure 20:
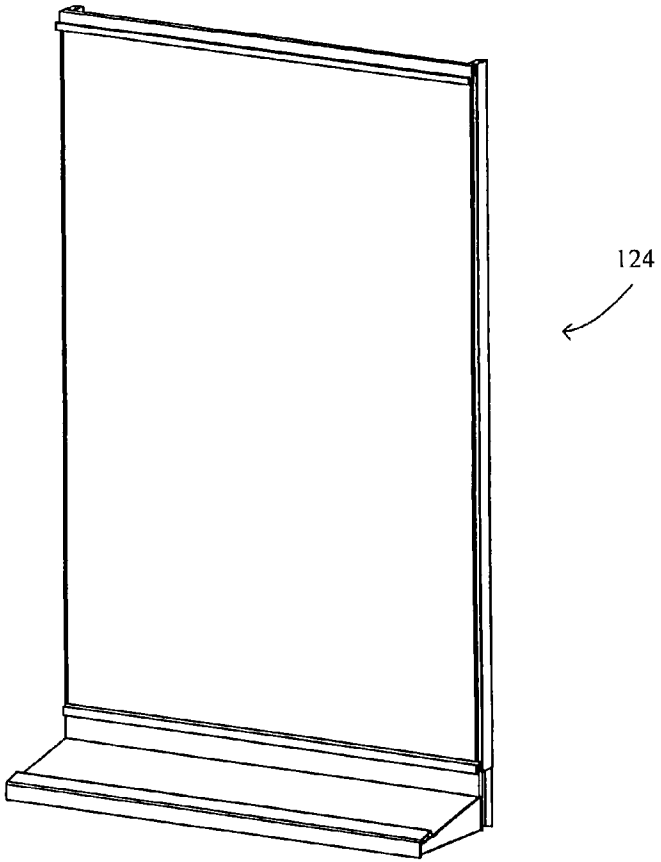
FIG. 20 is an exploded, front perspective view of a portion of a merchandise display system constructed in accordance with yet another form of the present invention.
Figure 20:
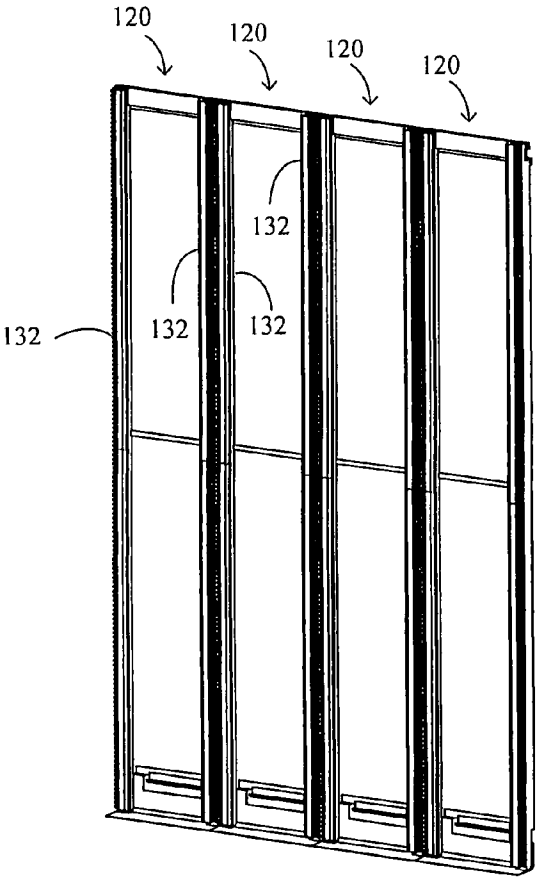
Figure 21:
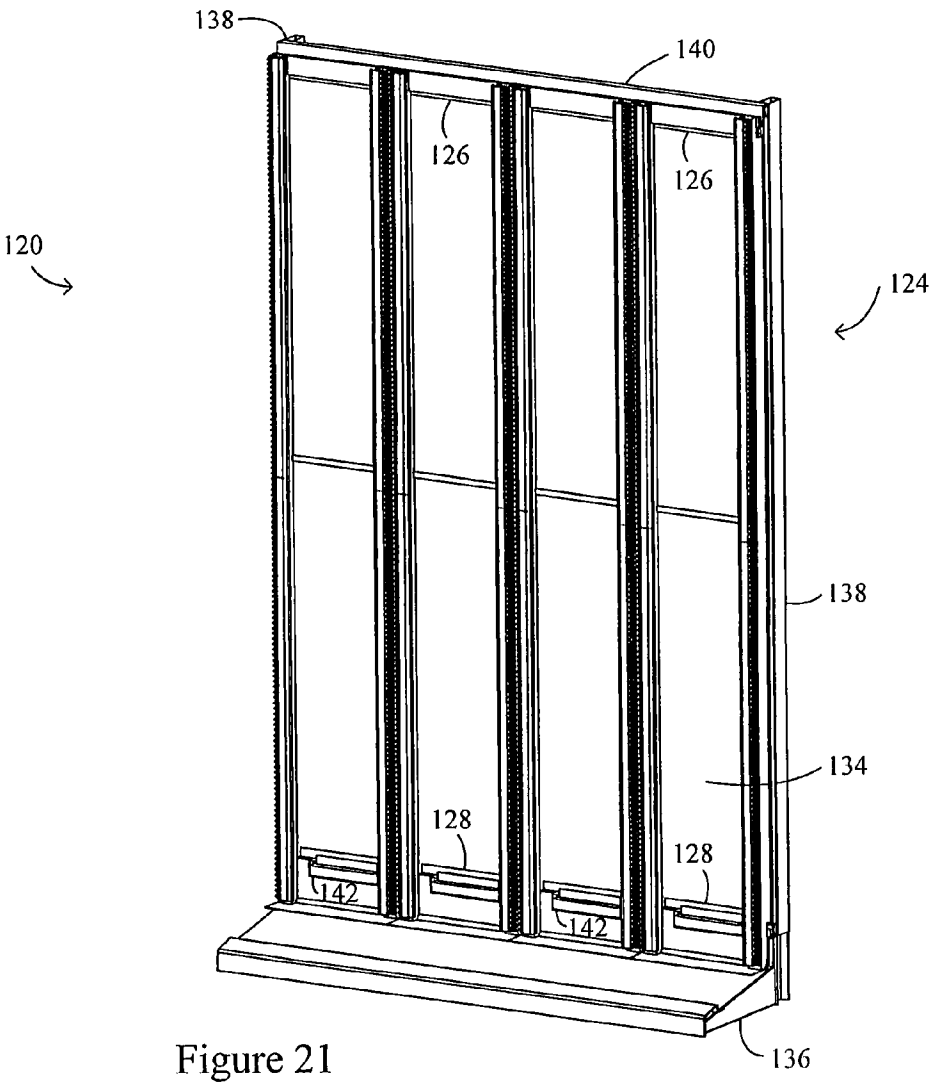
FIG. 21 is a front perspective view of the portion of the merchandise display system of the present invention shown in FIG. 20.

Referring initially to FIGS. 18-28, it will be seen that a modular merchandise display system constructed in accordance with the present invention includes a frame assembly 120, a plurality of merchandise display modules 122 (shown in FIGS. 29-43) mounted on the frame assembly 120, and a back wall support assembly 124. The frame assembly 120 may come in relatively narrow sections, such as about one foot in width, which may be mounted alone on the back wall support assembly 124, as shown in FIGS. 18 and 19, or mounted on the back wall support assembly with other similarly structured frame assemblies 120 in a side-by-side arrangement, as shown in FIGS. 20 and 21. Each frame assembly 120 includes an upper horizontal cross member 126, a lower horizontal cross member 128 and, optionally, one or more middle horizontal cross members 130 situated between the upper and lower horizontal cross members 126, 128. Each frame assembly 120 further includes a pair of spaced apart, vertical, parallelly disposed indexing members 132 having formed therein a plurality of arcuate or U-shaped recesses or openings 133 extending along their lengths. The vertical indexing members 132 are joined to the upper horizontal cross member 126, the lower horizontal cross member 128 and the one or more middle horizontal cross members 130.

The back wall support assembly 124 preferably includes a planar, vertical back wall 134, which may be formed of a solid sheet of material (e.g., plastic, metal, wood, pressed composition board or the like), or in the form of a pegboard having a multiplicity of holes and formed of a material such as described previously. The back wall support assembly 124 may also include a base 136 which rests on the floor of an establishment, vertical side pieces 138 attached to the base 136, an upper horizontal cross member 140 and a lower horizontal cross member 142. The back wall 134 is affixed to and supported by the vertical side pieces 138 and the upper and lower horizontal cross members 140, 142 of the back wall support assembly 124.

The upper and lower horizontal cross members 126, 128 of the frame assembly 120 include a provision for removably mounting the frame assembly to the back wall support assembly 124. As can be more clearly seen in FIGS. 22-24, the upper horizontal cross member 126 of the frame assembly 120 includes a horizontal rear wall 144, a top wall 146 perpendicularly joined to the rear wall 144 and a cantilevered hook plate 148 extending downwardly from the top wall 146 and spaced from the rear wall 144. Together, the rear wall 144, top wall 146 and hook plate 148 define a U-shaped channel 150 running along the length of the upper horizontal cross member 126 of the frame assembly 120. A preferably resilient pad 152, having an exposed concave lower surface portion 154, is affixed to the underside of the top wall 146 within the U-shaped channel 150.

The upper horizontal cross member 140 of the back wall support assembly 124 includes a front wall 156, a bottom wall 158 perpendicularly joined to the front wall 156, and a frame support hook wall 160 extending perpendicularly upwardly from the bottom wall 158 and spaced from the front wall 156. Together, the front wall 156, bottom wall 158 and frame support hook wall 160 of the upper horizontal cross member 140 of the back wall support assembly 124 define a U-shaped channel 162.

The upper free end of the frame support hook wall 160 preferably includes a bulbous bead 164 extending along the length the horizontal upper cross member 140 of the back wall support assembly 124. The frame assembly 120 is removably attached to the back wall support assembly 124 by lifting the frame assembly so that the cantilevered hook plate 148 of the upper horizontal support member 126 of the frame assembly 120 passes over the frame support hook wall 160 of the upper horizontal cross member 140 of the back wall support assembly 124 and is received by the U-shaped channel 162 of the back wall support assembly's upper horizontal member 140. The upper horizontal cross member 126 of the frame assembly 120 thus rests on the frame support hook wall 160 of the back wall support assembly's upper horizontal member 140, with the frame support hook wall 160 being received by the U-shaped channel 150 of the frame assembly's upper horizontal member 126, and the concave portion 154 of the resilient pad 152 resting atop the bulbous bead 164 of the frame support hook wall 160.

To further ensure the attachment of the frame assembly 120 to the back wall support assembly 124, the lower horizontal cross member 128 of the frame assembly 120 includes a locking clip 166 on its rear wall and extending along its length, the locking clip 166 defining an outwardly and downwardly extending surface that terminates in a lip 168. The locking clip 166 has a depth (front to back) so that it is closely received by an upwardly extending front U-shaped channel 170 partially defined by an upwardly extending wall 172 of the lower horizontal cross member 142 of the back wall support assembly 124 which is spaced from the front surface of this cross member, the lip 168 bearing against the inner surface of this upwardly extending wall 172.

Figure 23:
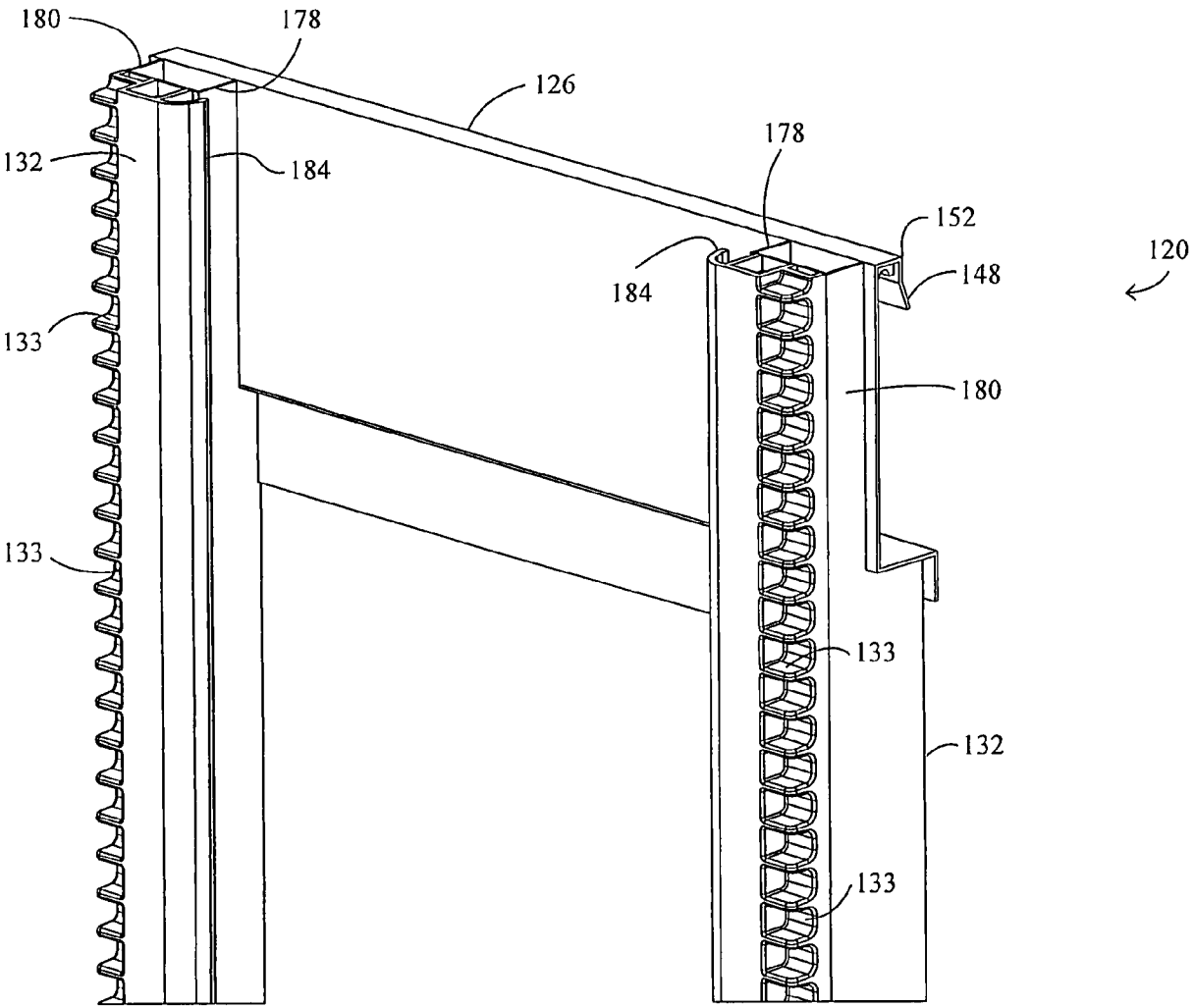
FIG. 23 is an enlarged front perspective view of a top portion of the merchandise display system of the present invention shown in FIG. 19.
Figure 24:
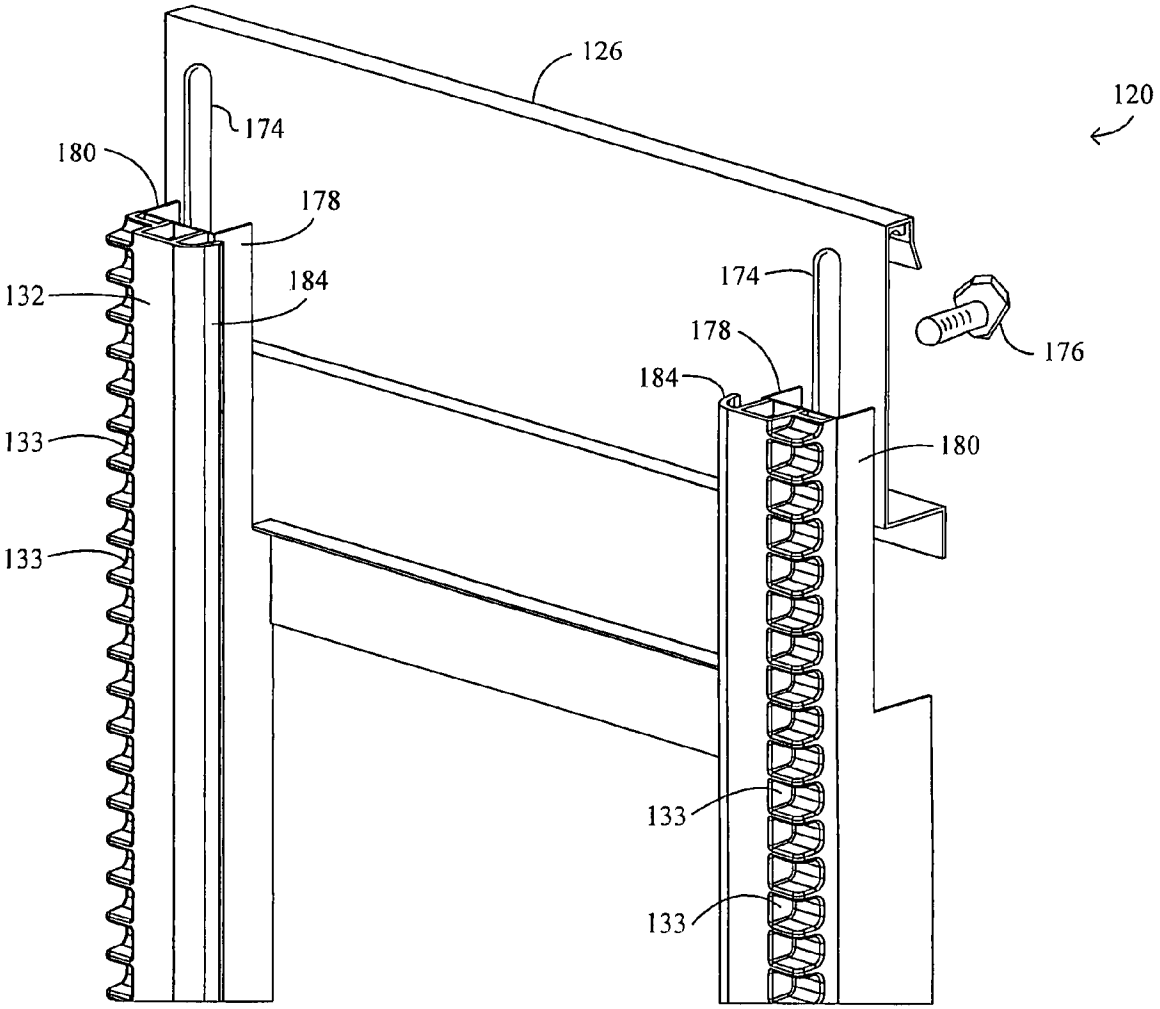
FIG. 24 is an enlarged front perspective view of the top portion of the merchandise display system of the present invention shown in FIG. 23, and illustrating the adjustability of the merchandise display system.
Figure 25:
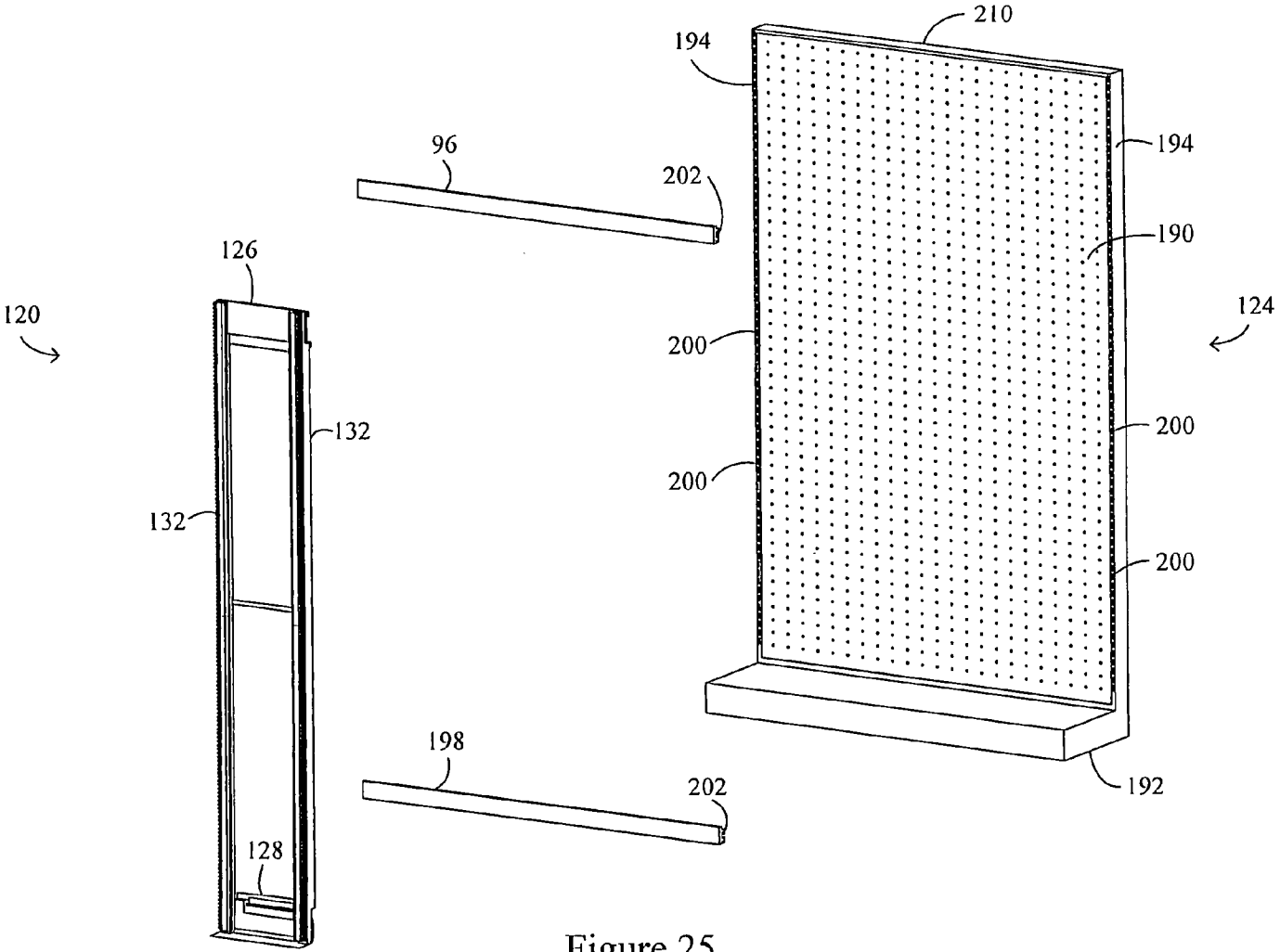
FIG. 25 is an exploded, front perspective view of a portion of a merchandise display system constructed in accordance with an alternative form of the present invention.
Figure 26:
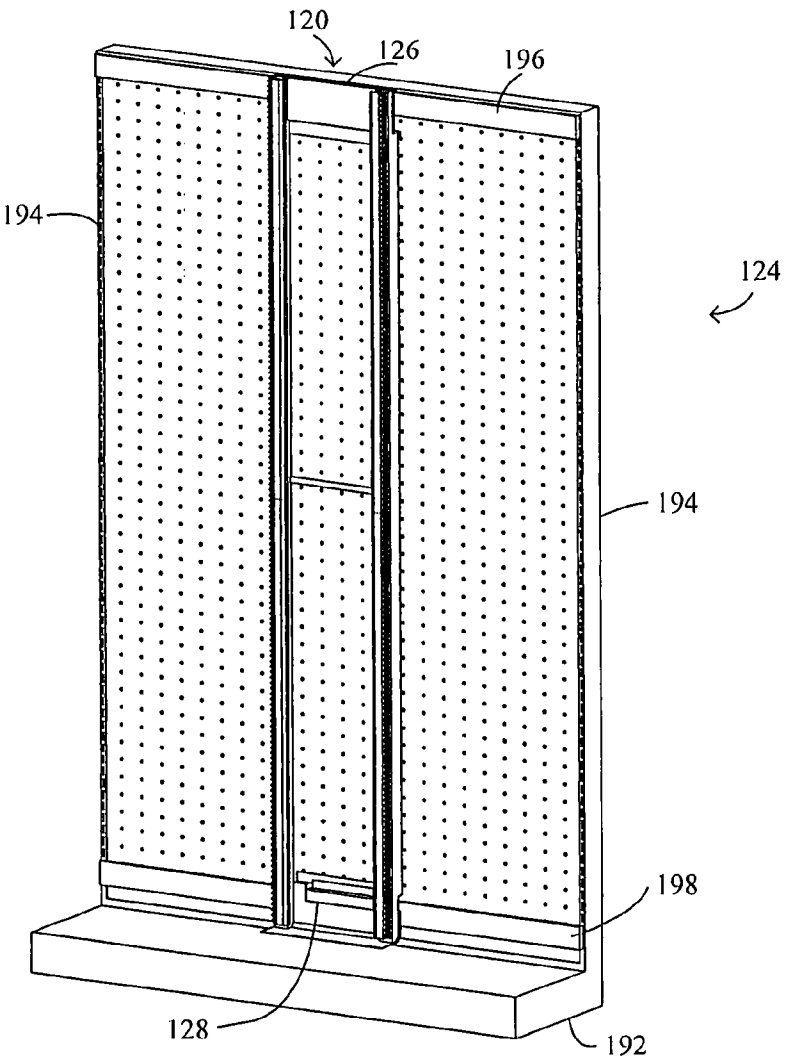
FIG. 26 is a front perspective view of the portion of the merchandise display system of the present invention shown in FIG. 25.
Figure 27:
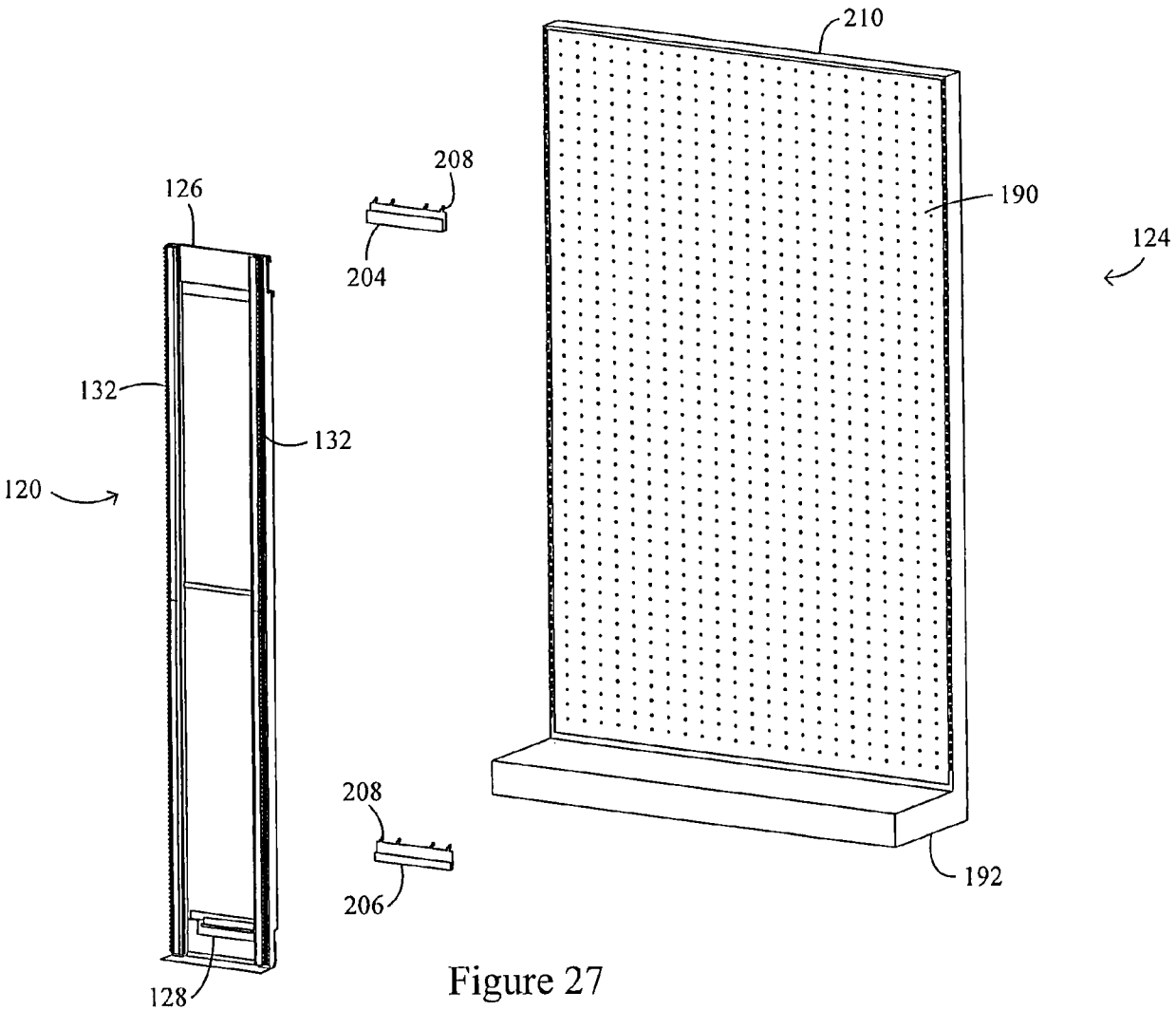
FIG. 27 is an exploded, front perspective view of a portion of a merchandise display system constructed in yet a further form of the present invention.

As shown in FIGS. 23 and 24, the upper horizontal cross member 126 of the frame assembly 120 may be adjustably attached to the vertical indexing members 132 so that the spacing between the upper and lower horizontal cross members 126, 128 of the frame assembly 120 is adjustable to make sure the locking clip 166 is fully engageable with the lower horizontal cross member 142 of the back wall support assembly 124 and to ensure that the frame assembly 120 is properly mounted on the back wall support assembly 124. To provide for such an adjustment, the upper horizontal cross member 126 of the frame assembly 120 may include vertically extending elongated slots 174 formed through its thickness which receive machine bolts or other fasteners 176 therethrough that are attached to the indexing members 132, as shown in FIG. 24.

As also can be seen in FIGS. 23 and 24, each indexing member 132 of the spaced apart pair of indexing members of each frame assembly 120 includes inner and outer lateral sides 178, 180, the inner lateral side 178 of one indexing member of the pair facing the inner lateral side 178 of the other indexing member of the pair, and with the outer lateral sides 180 facing away from one another. It should further be noted from FIGS. 23 and 24 that the plurality of arcuate or U-shaped recesses 133 are formed on the outer, non-facing lateral sides 180 of the indexing members 132 of each frame assembly 120, and that the inner, facing lateral sides 178 of the indexing members 132 include curved locking rails 184 extending outwardly from the inner lateral sides along the length of the indexing members 132. As will be explained, the arcuate recesses 133 are provided for at least partially receiving locator pins or protrusions 186 formed on the modules 122 of the merchandise display system, and the locking rails 184 are provided for engagement with locking wings 188 also forming part of the modules 122.

FIGS. 25-28 illustrate an alternative form of the display system of the present invention that is depicted in FIGS. 18-21. As mentioned previously, the back wall 134 could be a pegboard panel 190. The back wall support assembly 124 could include the pegboard panel 190, a base 192, vertical side pieces 194 affixed to the base 190, an upper horizontal back wall mounting member 196 and a lower horizontal back wall mounting member 198. The pegboard panel 190 is affixed to the vertical side pieces 194 and to the upper and lower horizontal back wall mounting members 196, 198. The vertical side pieces 194 include a plurality of slots 200 periodically spaced along their lengths. Each of the upper and lower horizontal back wall mounting members 196, 198 includes tabs 202 situated near their opposite axial ends and extending outwardly from the rear surfaces thereof. The tabs 202 hook into selected slots 200 on the vertical side pieces 194 to help hold the upper and lower horizontal back wall mounting members 196, 198, and the pegboard panel 190, in place on the vertical side pieces 194.

Figure 22:
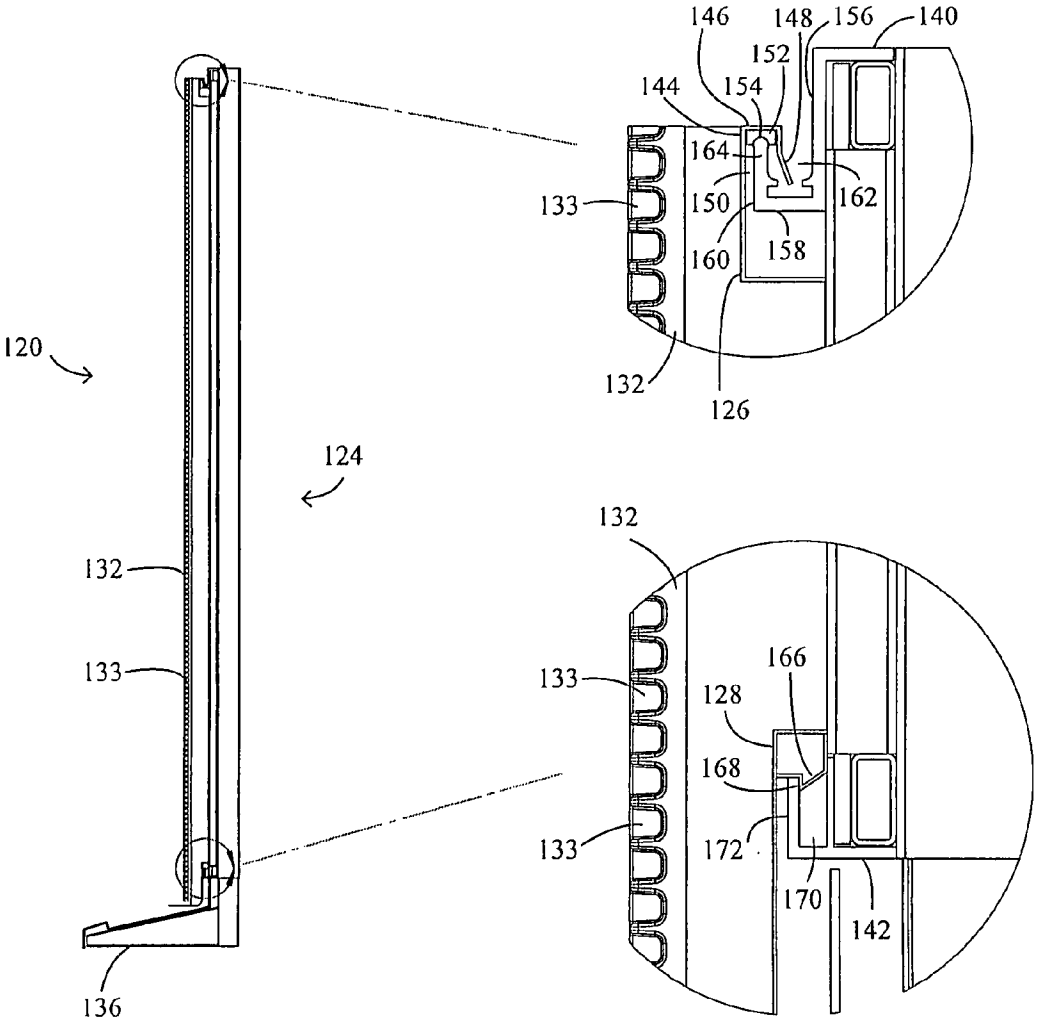
FIG. 22 is a side view and related detailed views of portions of the merchandise display system of the present invention shown in FIG. 21.

Each of the upper and lower horizontal back wall mounting members 196, 198 defines a U-shaped channel 150, 162, like those defined by the upper and lower horizontal cross members 140, 142 of the back wall support assembly 124 shown in FIGS. 22-24 so as to receive the cantilevered hook plate 148 and locking clip 166 respectively of the upper and lower horizontal cross members 126, 128 of the frame assembly 120 described previously. However, in the pegboard panel embodiment shown in FIGS. 24 and 28, the upper and lower horizontal back wall mounting members 196, 198 shown in FIGS. 25 and 26 may be respectively replaced with a pegboard upper back wall mounting member 204 and a pegboard lower back wall mounting member 206. Each of the pegboard mounting members 204, 206 defines a U-shaped channel 150, 162 as described previously with respect to the mounting members 196, 198 shown in FIGS. 25 and 26, but further include a plurality of spaced apart pegs 208 extending outwardly from the rear surface thereof which are receivable in corresponding holes of the pegboard panel 190 selected by the user in order to mount the frame assembly 120 on the pegboard panel 190 of the back wall support assembly 124. For this embodiment, the pegboard panel 190 is affixed to the vertical side pieces 194 secured to the base 192, and to a horizontal top rail 210 extending between the vertical side pieces 194.

Figure 28:
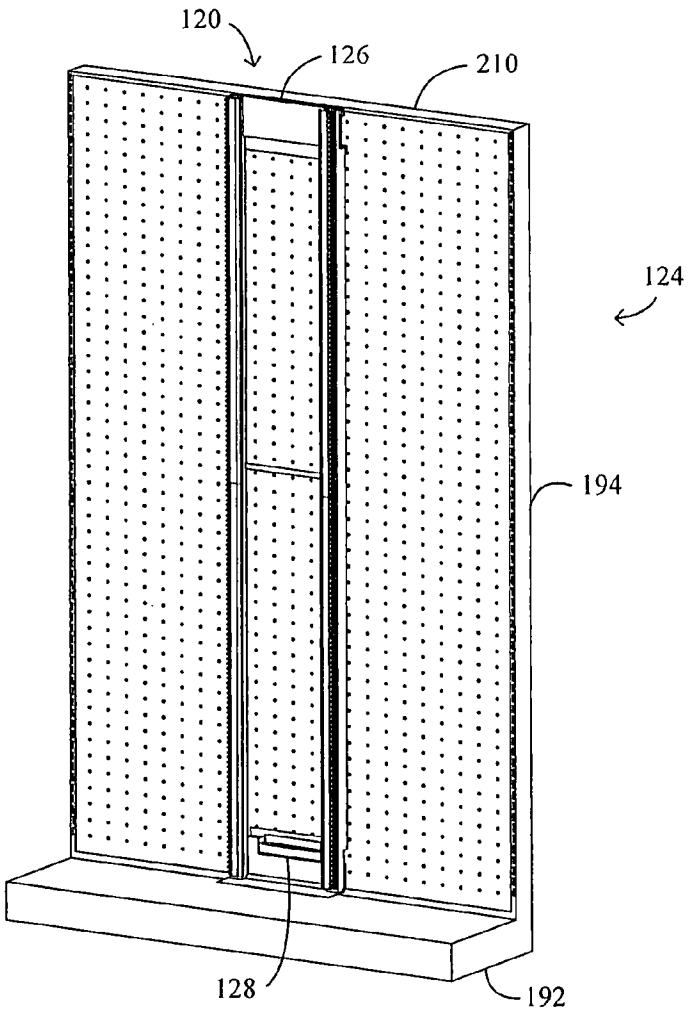
FIG. 28 is a front perspective view of the portion of the merchandise display system of the present invention shown in FIG. 27.

Although in FIG. 28 only one frame assembly 120 is depicted as being mounted on the back wall support assembly 124, it should be realized that several frame assemblies 120 may be mounted on the back wall support assembly 124 next to one another, such as with the embodiment of the display system shown in FIGS. 20 and 21.

As described previously, the merchandise display system of the present invention includes a plurality of modules 122. A preferred form of such modules 122 is shown in FIGS. 29-42.

Figure 29:
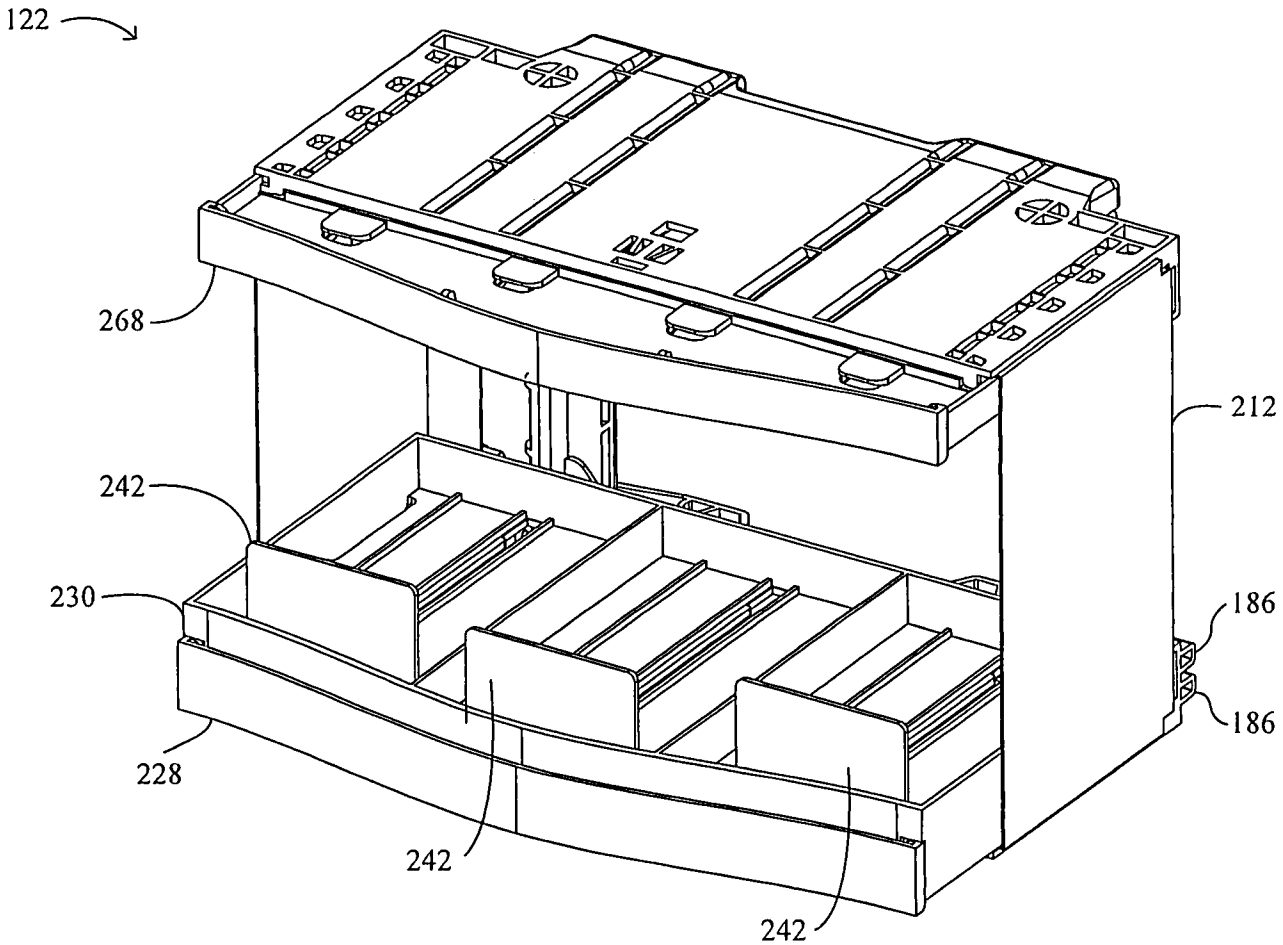
FIG. 29 is a front perspective view of a module constructed in accordance with the present invention and forming part of the merchandise display system of the present invention.
Figure 30:
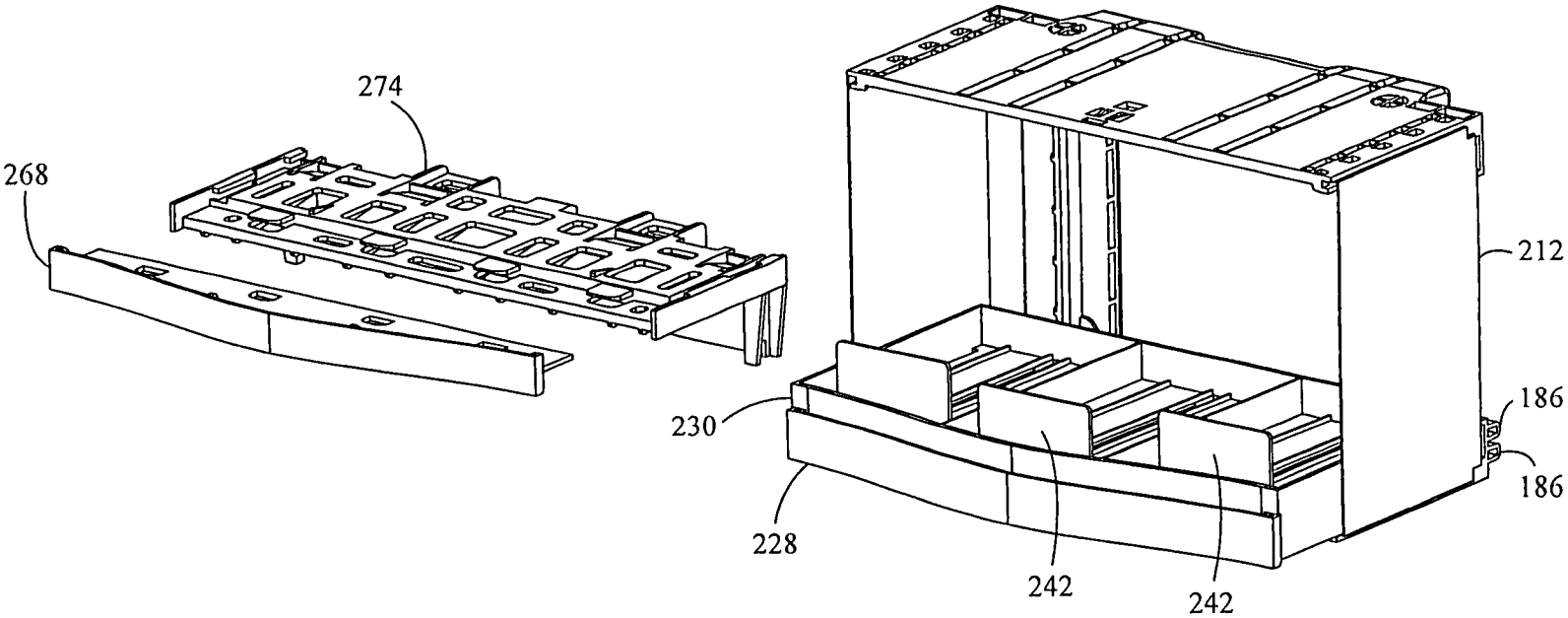
FIG. 30 is a partially exploded, front perspective view of the module of the present invention shown in FIG. 29.
Figure 31:
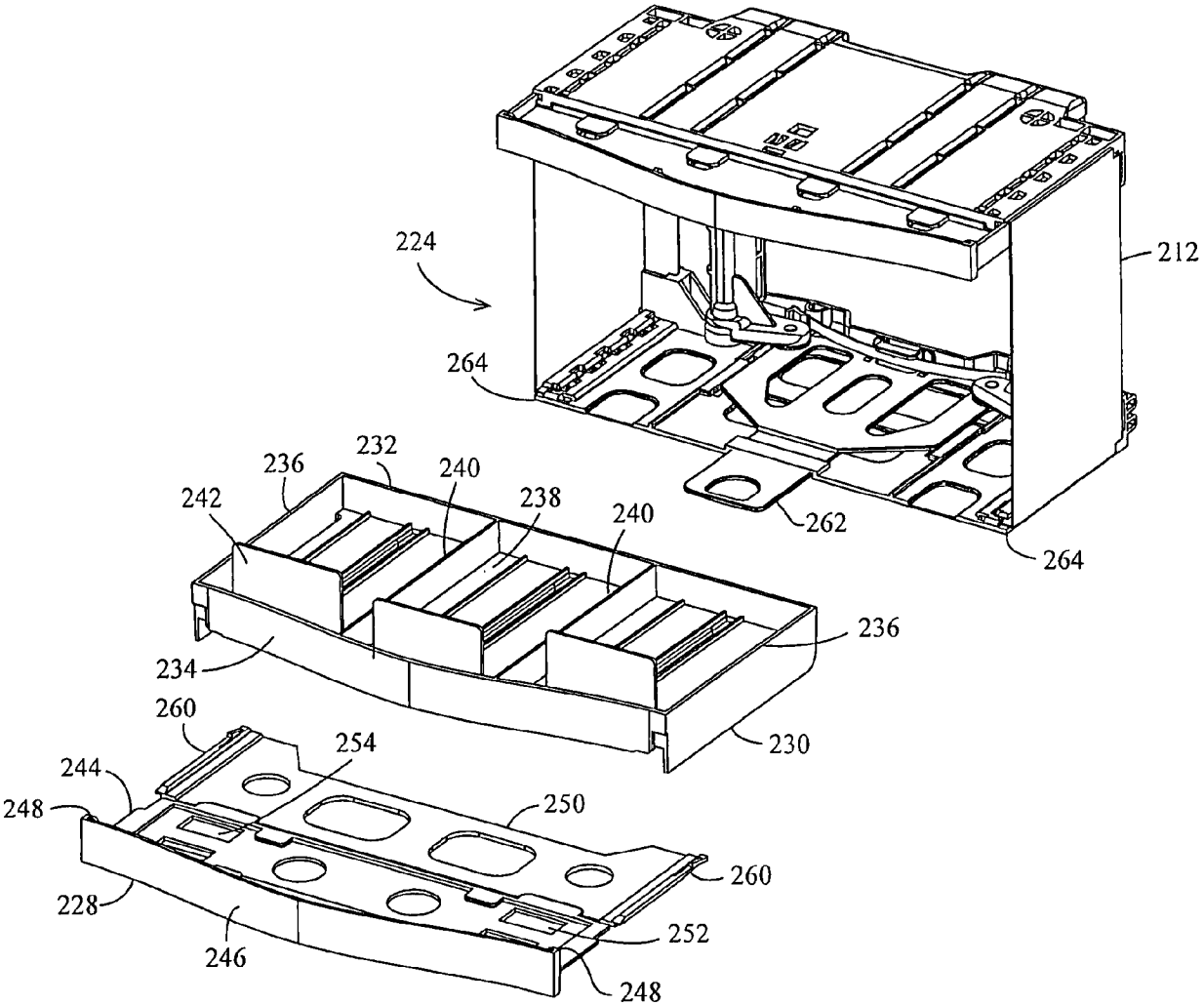
FIG. 31 is another partially exploded, front perspective view of the module of the present invention shown in FIG. 29.
Figure 32:
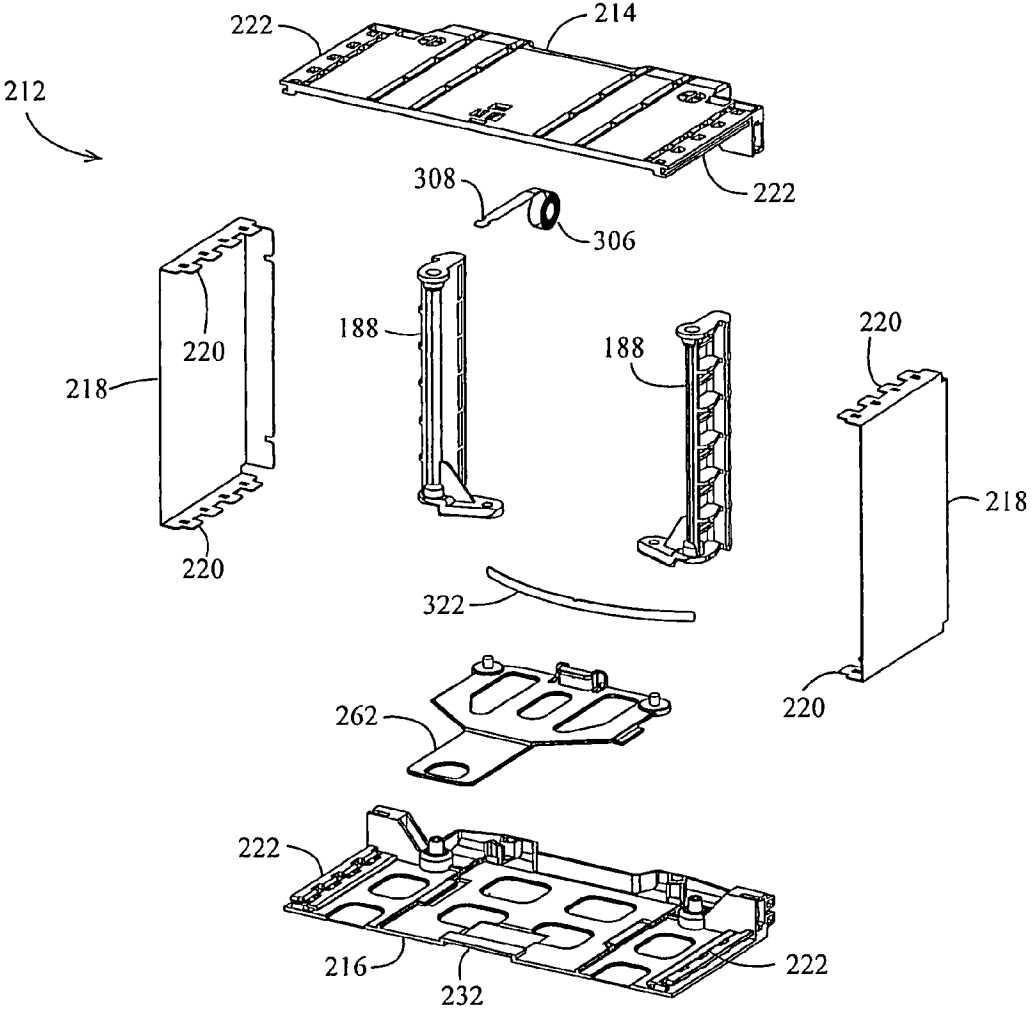
FIG. 32 is yet another partially exploded, front perspective view of the module of the present invention shown in FIG. 29.
Figure 33:
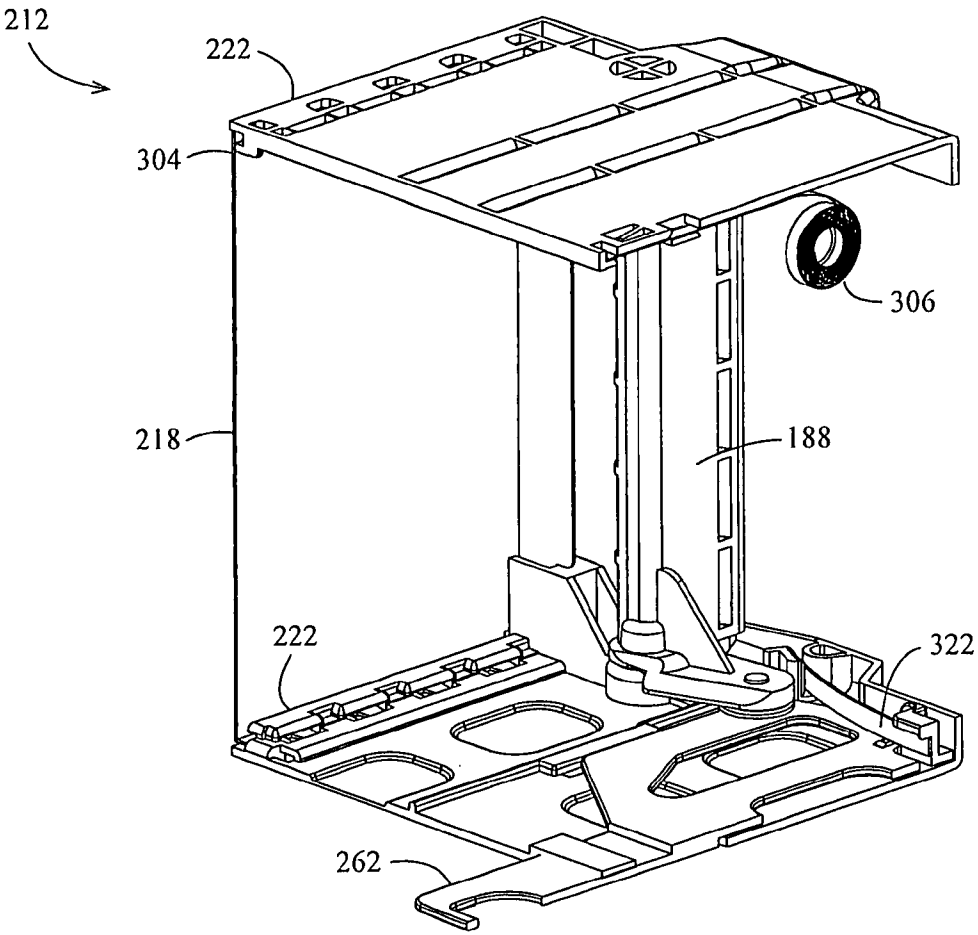
FIG. 33 is a partially cut away, front perspective view of a portion of the module of the present invention shown in FIG. 29.
Figure 34:
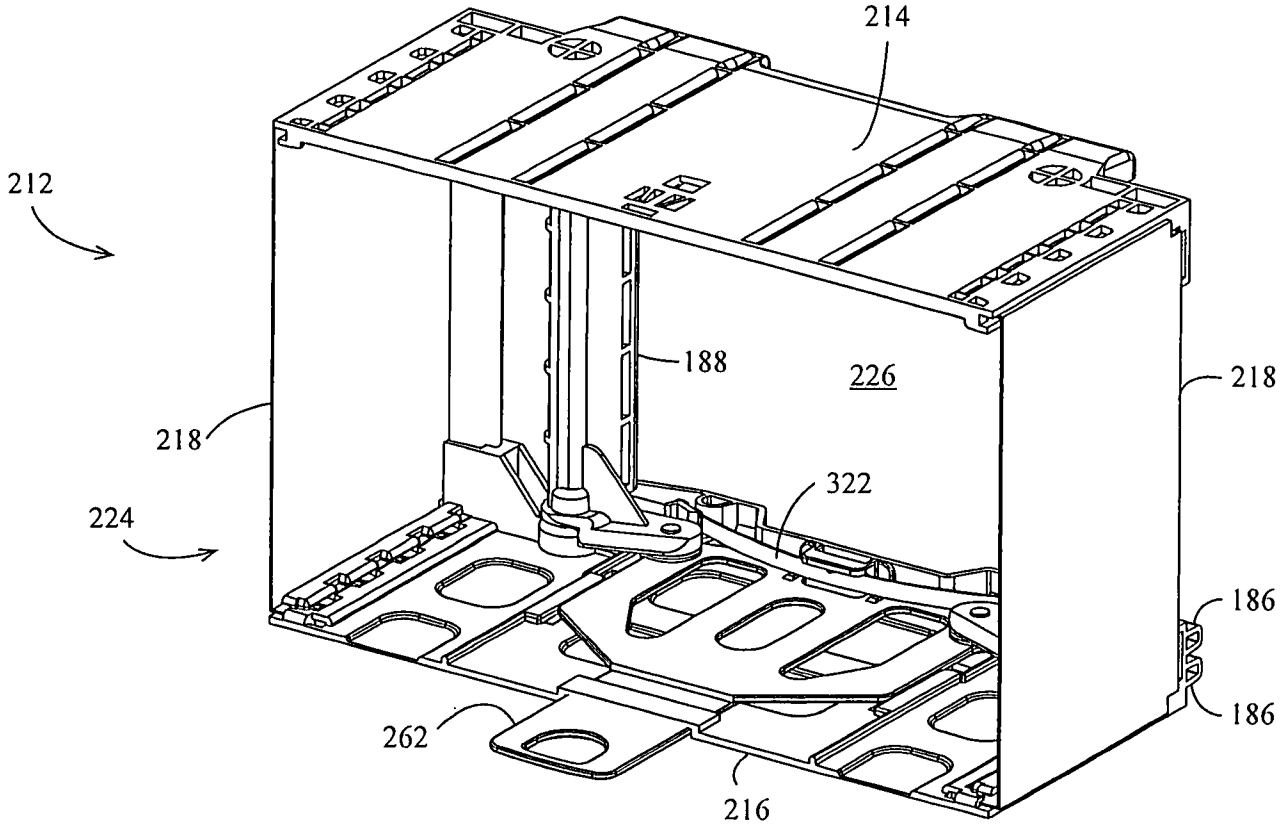
FIG. 34 is a front perspective view of a portion of the module of the present invention shown in FIG. 29.
Figure 35:
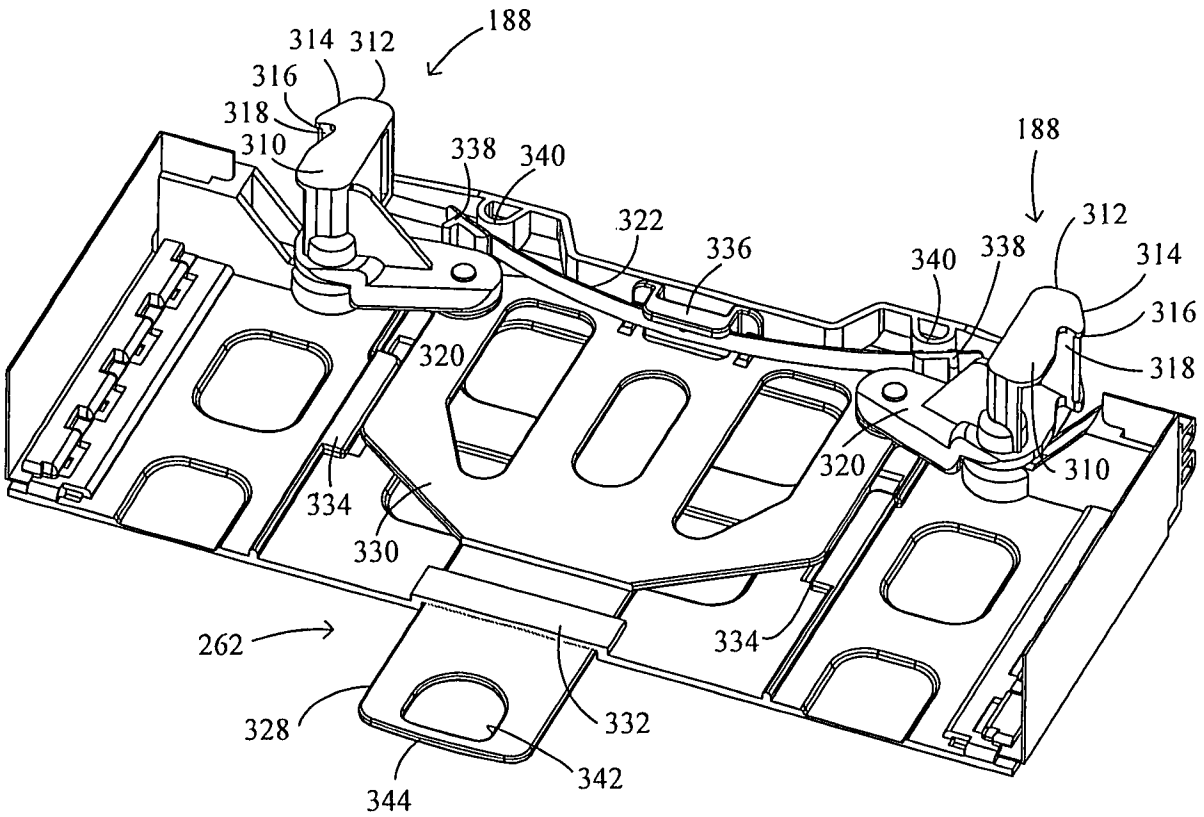
FIG. 35 is another front perspective view of a portion of the module of the present invention shown in FIG. 29.

As shown in FIGS. 29-31, the module 122 preferably includes a box-like module frame 212 which defines an interior area for displaying merchandise. The module frame 212, as can be seen in FIG. 32, includes a top wall 214, an opposite bottom wall 216, and two opposite side walls 218 which are joined to the top and bottom walls 214, 216. More specifically, the side walls 218 have a plurality of locking tabs 220 extending perpendicularly from the inner surface of each, which locking tabs 220 are received in corresponding slots formed in opposite lateral edge pieces 222 of the top and bottom walls 214, 216 to hold the module frame 212 together in a box-like shape. The module frame 212 includes a front opening 224 and an open or partially open rear side 226.

Slidably mounted on the bottom wall 216 of the module frame 212 is a UPC panel 228, and slidably mounted above the UPC panel 228 on the bottom wall 216 is an extendible and retractable tray 230. Both the UPC panel 228 and the tray 230 extend partially from the module frame 212 through the front opening 224.

The tray 230 includes a rear wall 232, an opposite front wall 234, two opposite side walls 236 and a floor 238. The tray 230 also has one or more vertically disposed divider panels 240 extending from the tray floor 238.

The divider panels 240 define compartments with the rear and front walls 232, 234, and the side walls 236, in which compartments are preferably housed product pusher trays 242, such as those disclosed in the aforementioned U.S. Pat. No. 6,105,791. The tray 230 is extendible from the front opening 224 of the module frame 212 by the user so that new merchandise may be loaded into the pusher trays 242 carried on the tray 230.

Figure 39:
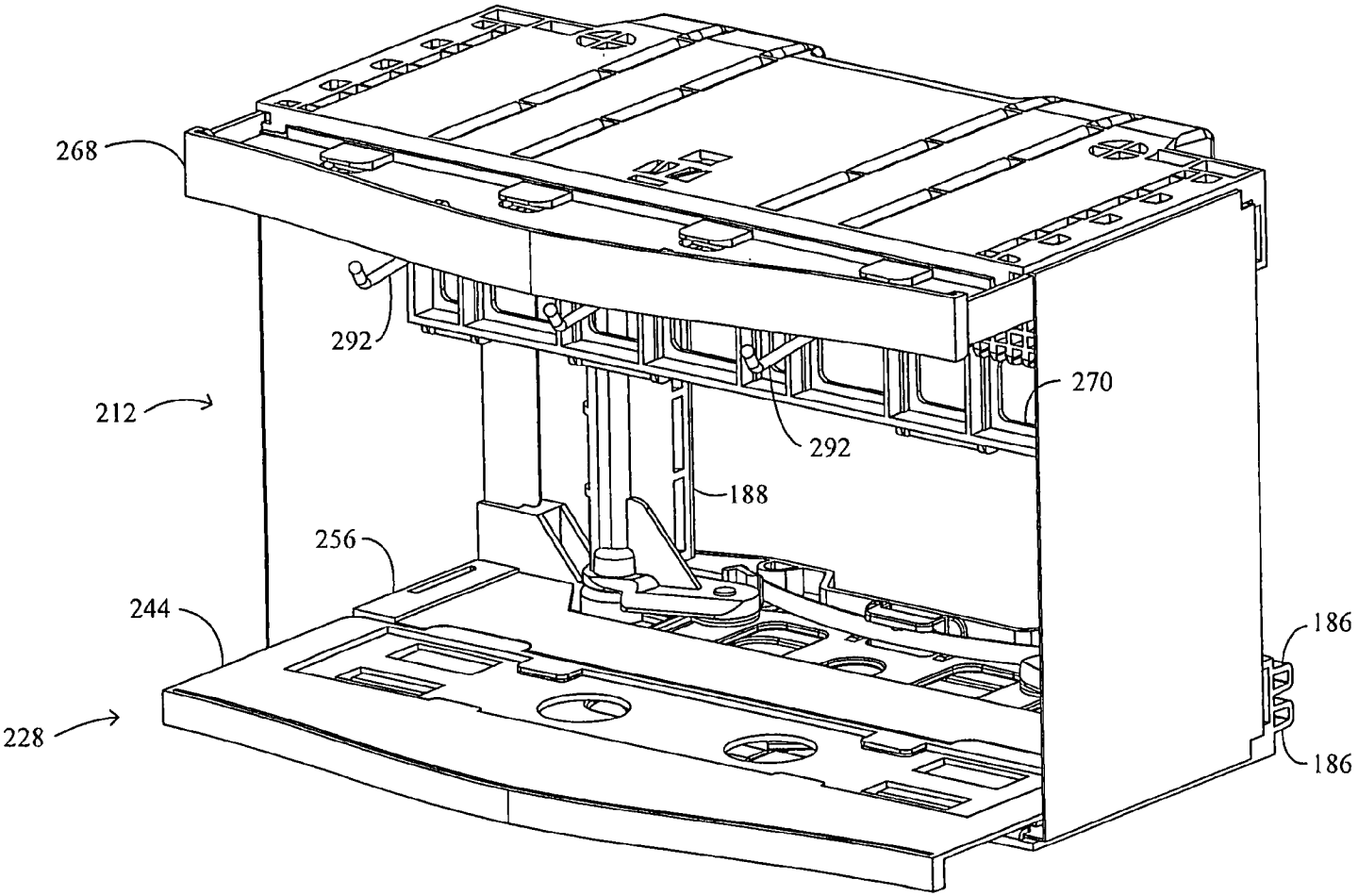
FIG. 39 is a front perspective view of a portion of the module of the present invention shown in FIG. 29.
Figure 40:
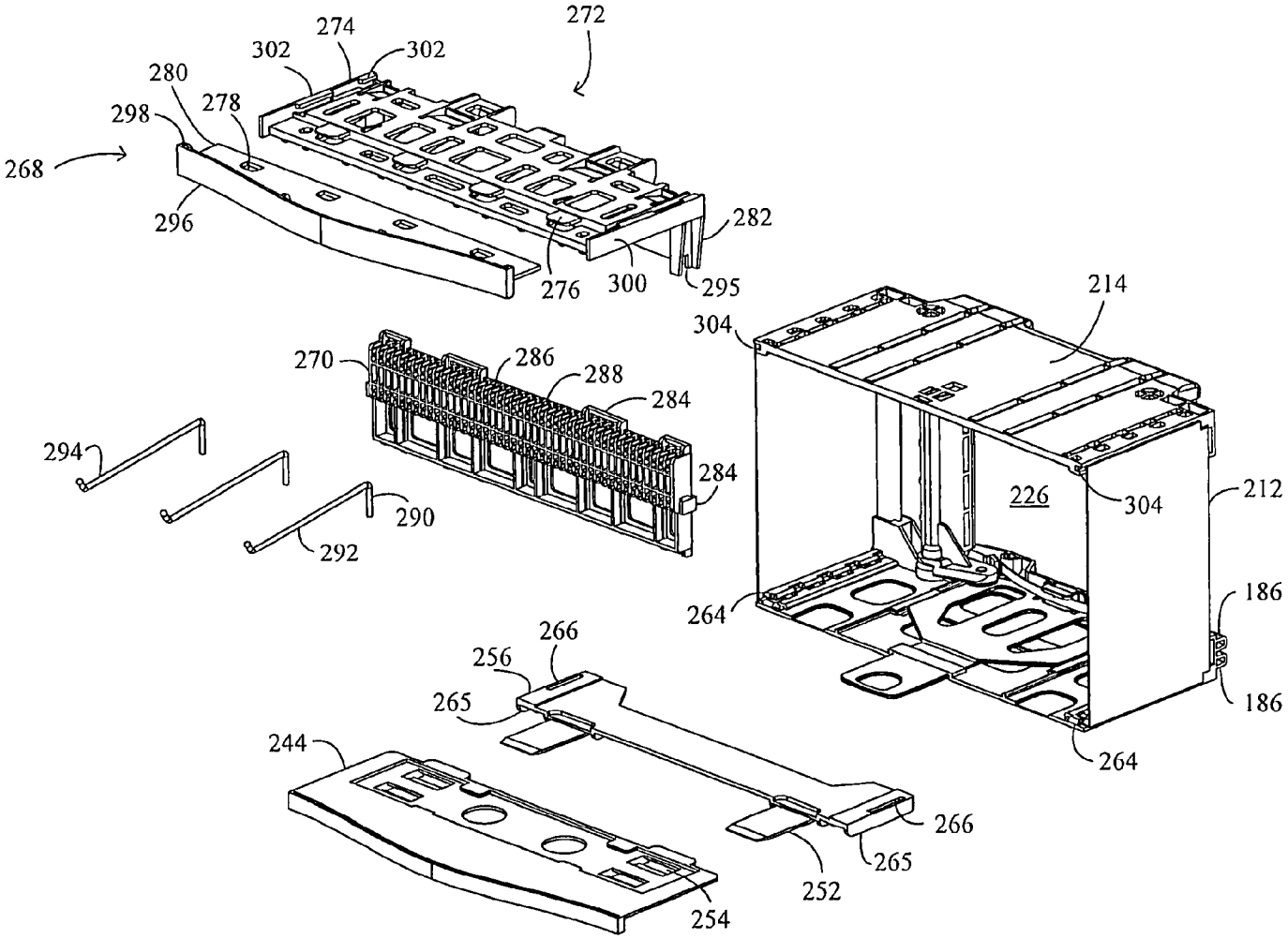
FIG. 40 is a partially exploded, front perspective view of the portion of the module of the present invention shown in FIG. 39.
Figure 41:
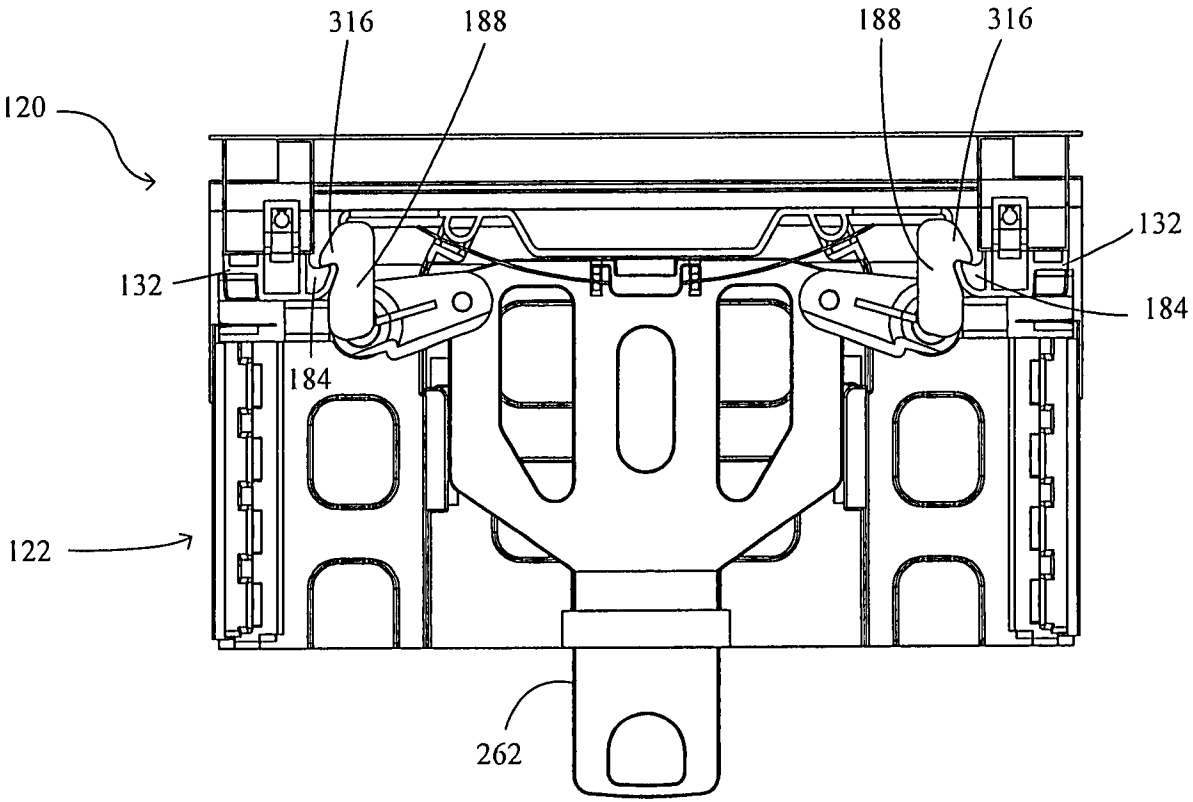
FIG. 41 is a top plan view of a portion of the module of the present invention shown in FIG. 29.
Figure 42:
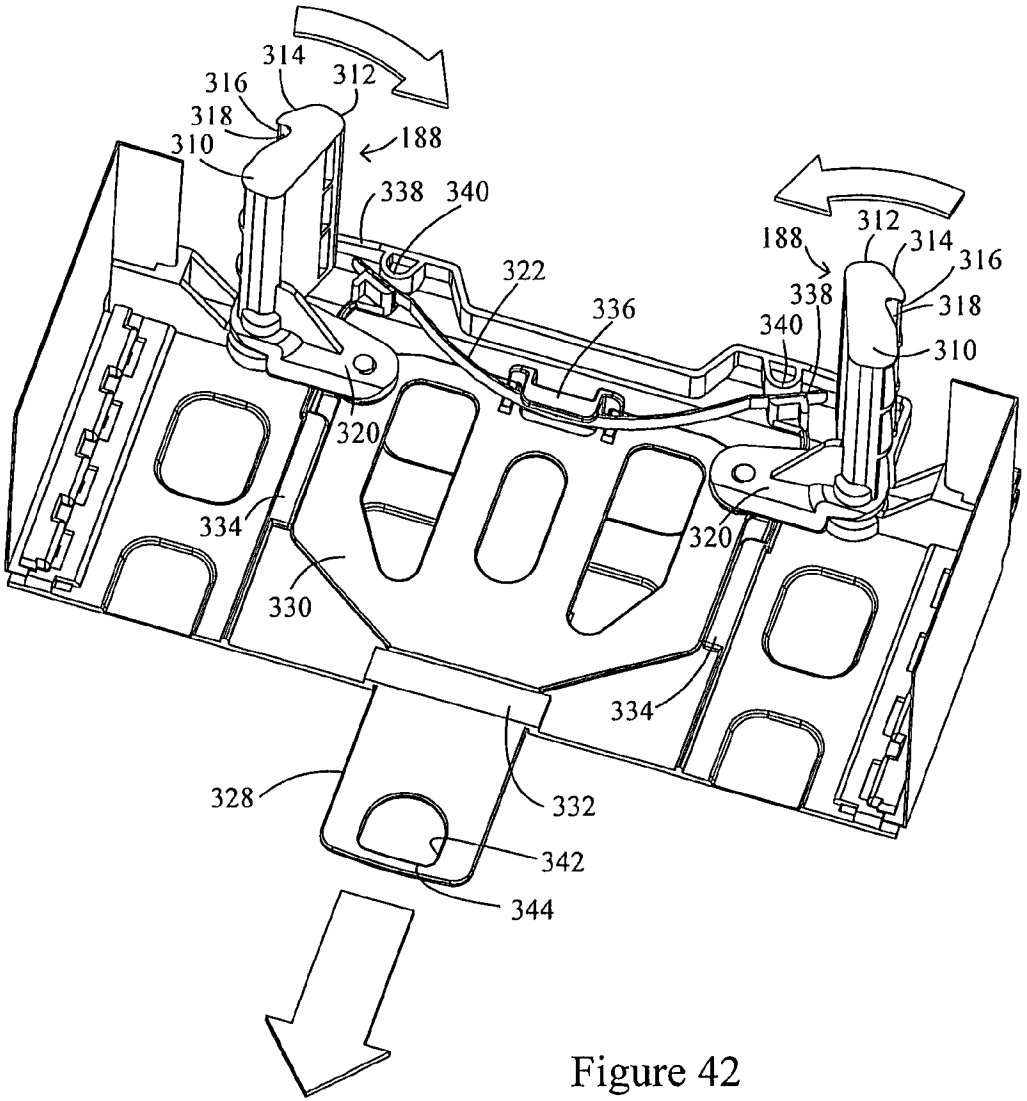
FIG. 42 is a top perspective view of the portion of the module of the present invention shown in FIG. 41, and illustrating the operation of the module.

As can be seen in FIGS. 31, 39 and 40, the UPC panel 228 preferably is formed from two interlocking pieces, a front piece 244 having a clear plastic or transparent vertical front wall 246 having turned-in lateral edges 248 which define channels for holding a graphic display behind the transparent front cover or wall 246, and a rear piece 250 substantially co-planarly joined to the front piece 244 via interlocking tongues 252 on the rear piece 250 being received by aligned slots 254 formed in the front piece 244.

The rear piece 250 of the UPC panel 228 includes two upstanding resilient tabs 260 situated on the top surface of the panel, which tabs are received by, and can move reciprocatingly within, corresponding channels (not shown) formed on the underside of the tray 230. The tabs 260 and tray channels allow the UPC panel 228 to be extended from the front opening 224 of the module 122 only a predetermined distance, in order to enable the user of the display system to more easily change the graphics of the UPC panel front cover 246, but also to more easily allow the user to gain access to a release bar 262 situated underneath the UPC panel 228 when it is desired to remove the module 122 from the frame assembly 120 of the display system, as will be explained in greater detail.

The bottom edges of the side walls 236 of the tray 230 ride in channels 264 defined by the lateral side walls 218 of the module frame 212 and the lateral edge pieces 222 of the bottom wall 216 of the module frame. This structure allows the tray 230 to be extended from, and retracted into, the interior area of the module frame 212, but it should be noted that the UPC panel 228 can be extended and retracted independently of the tray 230.

If the tray 230 is not used in the module 122, which is the situation shown in FIG. 39, when hooks are used on which products are hung rather than being placed on the tray, a UPC slide cover 256 is used in its place. The UPC slide cover 256 takes the place of the rear piece 250 of the UPC panel 228. The slide cover 256 also has tongues 252 which are received by the slots 254 of the front piece 244 to interlock the slide cover 256 with the front piece 244 of the UPC panel 228. The slide cover 256 rides on its lateral edges 265 in the same channels 264 in which the tray 230 would have ridden, and includes downwardly extending projections on its bottom side formed by elongated cutouts 266 through its thickness to maintain the UPC panel 228 coupled to the module frame 212 as the panel is moved in and out of the module front opening 224.

Also, as can be seen in FIGS. 29, 30 and 40, the module 122 may further include a header assembly. The header assembly is formed of a front header piece 268, a header hook bar 270 and a header hook bar slide 272. The header piece 268 is co-planarly joined to a main body portion 274 of the header hook bar slide 272 by spaced apart tabs 276 formed on the hook bar slide 272 which lockingly engage with cooperating openings 278 formed in the rear plate 280 of the header piece 268. A bottom piece 282 of the hook bar slide 272, which extends perpendicularly from the rear of the main body portion 274, is similarly joined co-planarly to the hook bar 270 with interlocking tabs 284 extending upwardly from the top edge and/or sides of the hook bar 270 and slots 285 formed in the lower edge of the bottom piece 282 of the hook bar slide 272.

The hook bar 270 has a plurality of bores 286 formed therein and situated between adjacent divider walls 288 of a plurality of divider walls. The bores 286 are provided to receive the bent ends 290 of product holding hooks 292. Adjacent divider walls 288 prevent lateral movement of a product holding hook 292 when it is received by a bore 286 situated between the divider walls. The product hooks 292 have bulbous free ends 294 situated opposite the bent ends 290 on which products may be hung. The hooks 292 are used to display merchandise in the module 122 in lieu of the tray 230.

The header piece 268 preferably includes a transparent vertical front wall 296 joined to the front edge of the rear plate 280. Like the UPC panel 228, the front wall 296 has turned-in side edges 298 which define a channel for receiving graphics or printed material behind the front wall which can be seen through the transparent front wall 296.

The hook bar slide 272 includes opposite lateral side walls 300 on which are situated slide tabs 302 turned inwardly of the hook bar slide to face each other. The slide tabs 302 are received in cooperating slots 304 formed in the opposite lateral edges of the top wall 214 of the module frame 212 so that the header assembly, including the front header piece 268, the hook slide bar 272, the hook bar 270 and hooks 292 mounted thereon, is suspended from the top wall 214 of the module frame 212 within the interior space or area thereof, and is extendible from the front opening 224 and retractable within the module interior space, so that a user may more easily add products to the exposed hooks 292.

A coiled spring 306 affixed to the top wall 214 has its free end 308 attached to the header assembly so that the header assembly may more easily retract into the module frame 212 from an extended position under the bias of the spring 306.

The mechanisms for locking the module to the frame assembly 120 of the merchandise display system, and for releasing the locking mechanism to remove the module 122 therefrom, will now be explained, and reference should be had to FIGS. 32-42 of the drawings. The locking mechanism in this embodiment to be described is very similar in operation to the mechanism described previously and shown in FIGS. 1-17 of the drawings. However, it should be noted that in the embodiment shown in FIGS. 32-42, the arcuate recesses 133 of the indexing members 132 are formed on the outside, non-facing lateral sides 180 of the indexing members 132, and the locking wings 188 engage the indexing members 132 of a pair of indexing members on their inner, facing lateral sides 178.

More specifically, the module 122 includes a pair of locking wings 188 pivotally mounted on the bottom wall 216 of the module frame 212 and extending upwardly therefrom and outwardly from the open rear side 226 of the module. The locking wings 188 are spaced apart from each other a predetermined distance so that they may engage the inner lateral sides 178 of corresponding indexing members 132 of a pair of indexing members.

Each locking wing 188 of the pair extends vertically from the bottom wall 216 of the module frame 212, and has a main portion 310 that is structured to include a free end 312 having a leading, laterally outwardly sloping camming surface 314 facing away from one another, the camming surfaces 314 leading toward a more inwardly located hooked edge 316 and a recess or pocket 318 adjacent the hooked edge 316.

Each locking wing 188 also includes an extended portion 320 situated at an angle to the main portion 310 thereof at the bottom of the locking wing 188 where it is pivotally joined to the bottom wall 216 of the module frame 212. The extended portion 320 of each locking wing 188 is pivotally joined to a release bar 262 which is biased in a direction into the module by a leaf spring 322, so that the release bar 262, in turn, biases the locking wings 188 to turn in opposite outward directions so that they will engage the inner facing lateral sides 178 of the indexing members 132.

Figure 36:
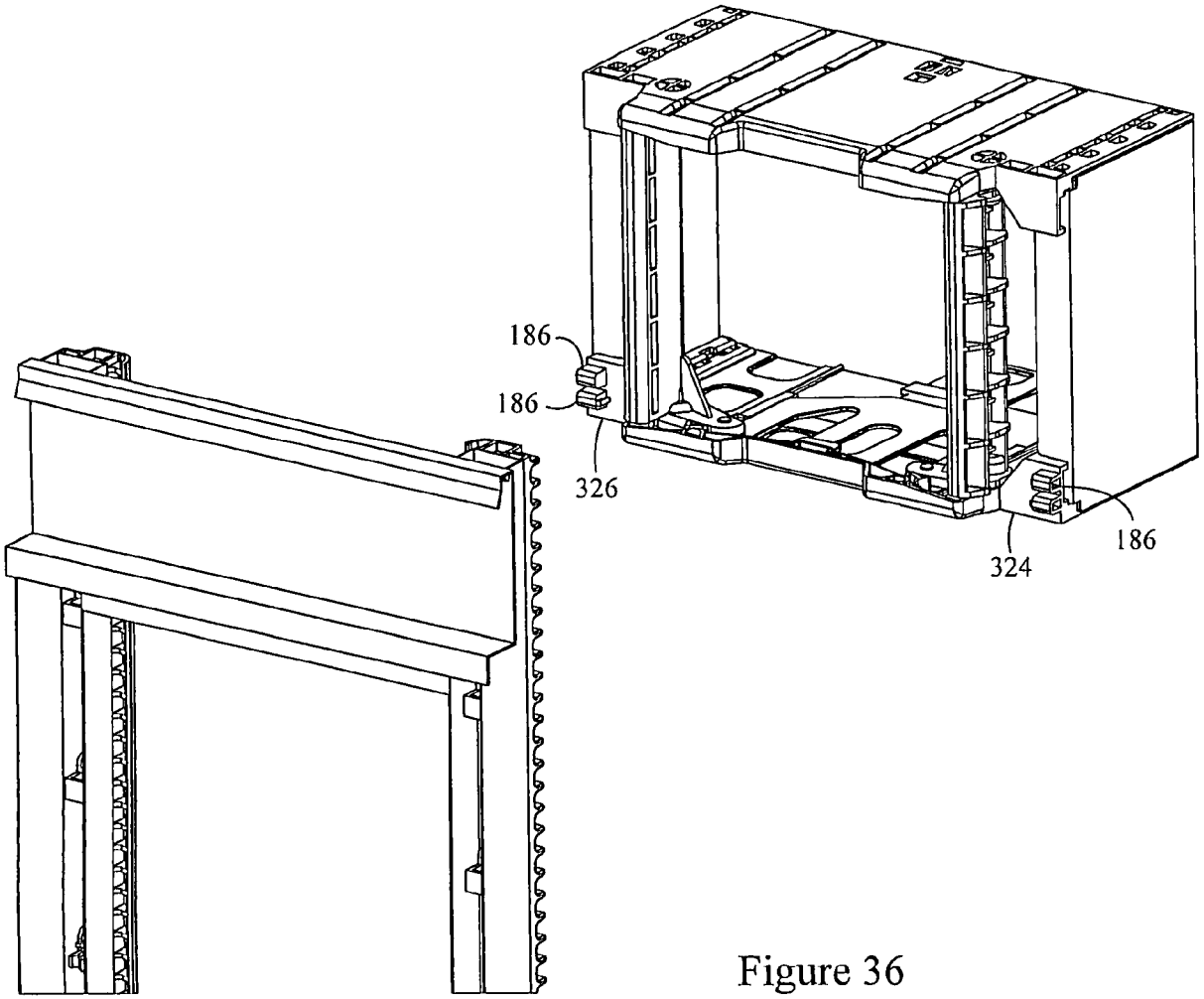
FIG. 36 is a partially exploded, front perspective view of portions of the merchandise display system of the present invention shown in FIGS. 18 and 29.
Figure 37:
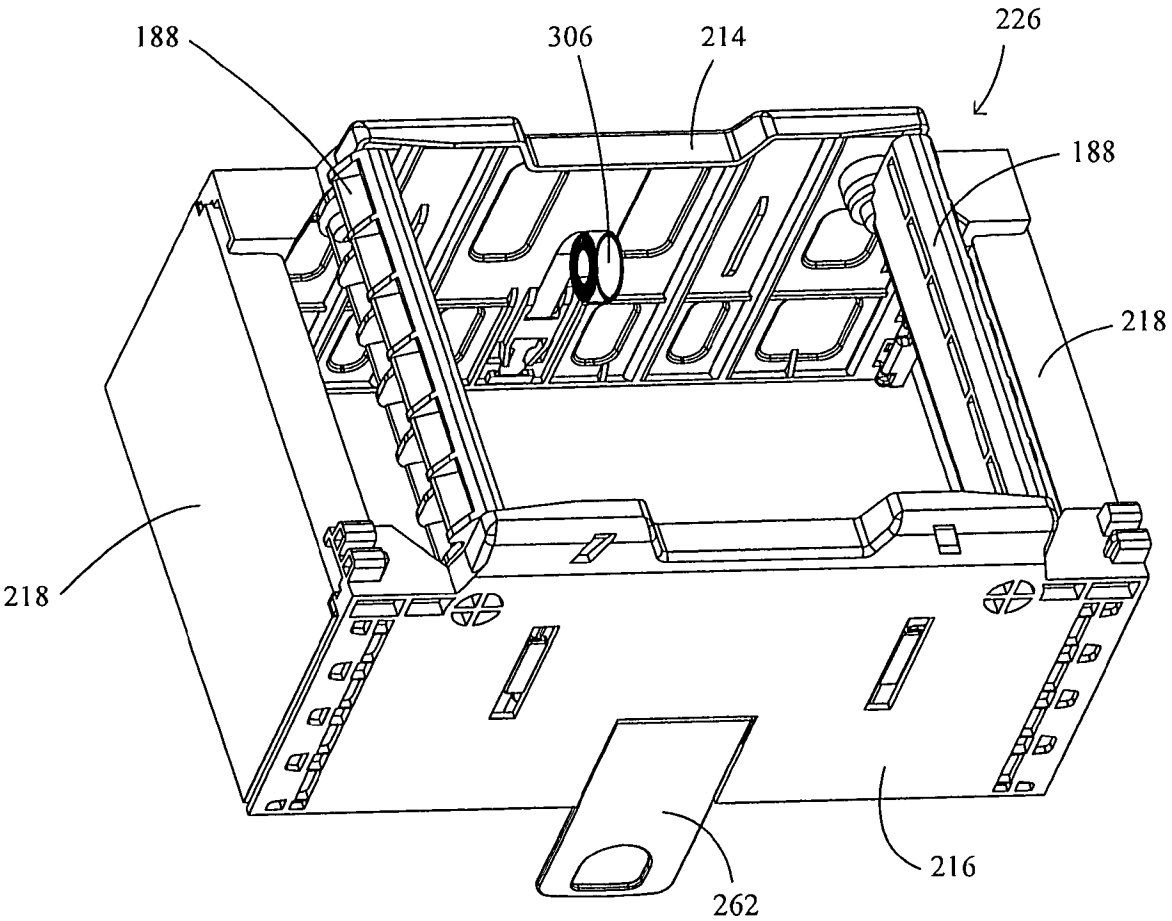
FIG. 37 is a rear perspective view of a portion of the module of the present invention shown in FIG. 29.
Figure 38:
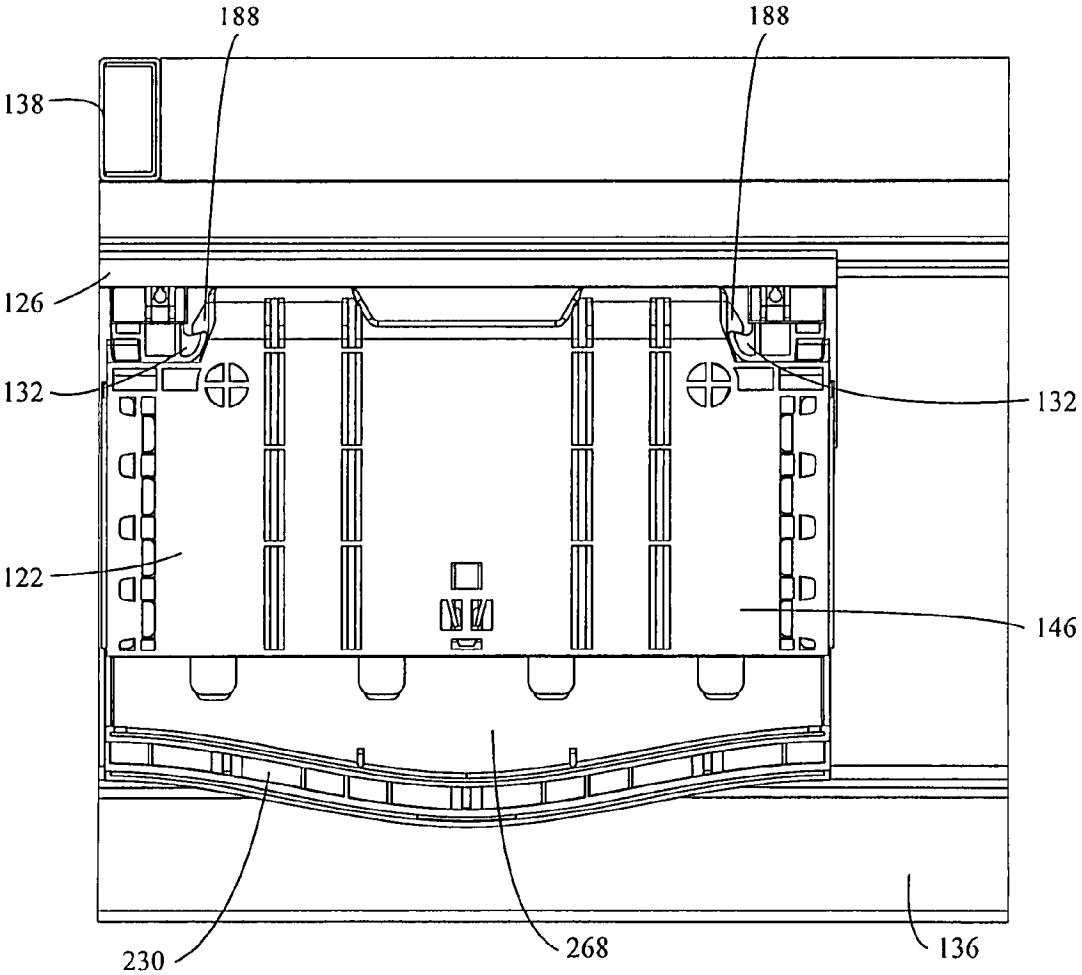
FIG. 38 is a top view of a portion of the module of the present invention shown in FIG. 29 mounted on the portion of the merchandise display system of the present invention shown in FIG. 18.

As shown in FIGS. 29, 36 and 37, each module 122 includes a first set of adjacent locator protrusions 186 (also referred to herein as pins) situated on a first vertical rear extension segment 324 of the bottom wall 216 near one lateral side wall 218 of the module frame 212, and a second set of adjacent locator protrusions 186 situated on a second vertical rear extension segment 326 of the bottom wall 216 near the other lateral side wall of the module frame. The locator protrusions 186 of the first and second sets have a shape which complements that of the arcuate recesses 133 of the indexing members 132 so that they may be closely received by two corresponding adjacent arcuate recesses 133 on the non-facing lateral sides 180 of each indexing member 132 of the pair of indexing members when the module 122 is mounted on the frame assembly 120 of the display system.

More specifically, when a module 122 is being mounted on the frame assembly 120, the locator protrusions 186 of the module are aligned with corresponding arcuate recesses 133 formed in the indexing members 132, and the module is pushed toward the front face of the frame assembly 120, with the locator protrusions 186 registering with certain arcuate recesses 133 of the indexing members 132. The locking rails 184 extending from the facing lateral sides 178 of the indexing members contact the camming surfaces 314 of the locking wings 188, spreading the locking wings apart from one another against the bias of the spring 322. As the module 122 is continued to be pushed into the frame assembly 120, the indexing members 132 move past the camming surfaces 314 of the locking wings 188 until the hooked edges 316 of the locking wings engage the locking rails 184 of the indexing members 132, the locking rails 184 further being received by the pockets or recesses 318 of the locking wings 188. The locking wings 188, which are biased in a direction away from each other, latch onto the indexing members 132 between the pair of indexing members. With the locator protrusions 186 registered with selected arcuate recesses 133 of the indexing members 132 and the locking wings 188 closely engaging the locking rails 184 of the indexing members 132, the product module 122 is now securely mounted to the frame assembly 120 of the merchandise display system.

Each module 122 includes a release mechanism to allow the store owner to remove a module from the frame assembly 120 of the merchandise display system. As can be seen from FIGS. 35 and 42 of the drawings, the release mechanism includes an elongated release bar 262 which is mounted above the bottom wall 216 of the module frame 212 and below the UPC panel 228. The release bar 262 includes a narrowed front section 328, and a widened rear section 330 joined to the narrowed front section 328. The bottom wall 216 of the module frame 212 defines a tunnel 332 through which the narrowed front section 328 of the release bar 262 may move reciprocatingly and by which the release bar is held captive. The widened rear section 330 of the release bar 262 has its opposite lateral edges situated under corresponding ledges 334 raised from the top surface of the bottom wall 216 and extending over the opposite lateral edges of the widened rear section 330 of the release bar in a direction facing each other. Thus, the widened rear section 330 of the release bar 262 is also held captive under these ledges 334, but is allowed to move reciprocatingly thereunder so that the release bar 262 may move on the bottom wall 216 of the module frame 212 reciprocatingly in a front-to-back direction.

The opposite rear corners of the widened rear section 330 of the release bar 262 are pivotally joined to the angled extended portions 320 of the locking wings 188. Thus, when a user of the merchandise display system pulls on the release bar 262 in an outward direction, the locking wings 188, because of their attachment to the release bar 262, rotate towards one another in the direction of the arrows shown adjacent to the locking wings in FIG. 42.

A leaf spring 322, as mentioned previously, is used to bias the release bar 262 in a direction into the module frame 212. An upstanding clamp 336, situated on the top surface of the release bar 262 at the middle rear portion of the widened rear section 330, securely holds the middle of the leaf spring 322. The opposite ends of the leaf spring 322 are loosely held in gaps defined by two vertical projections 338, 340 extending from the top surface of the bottom wall 216 of the module frame 212 at the leaf spring ends to hold the ends of the leaf spring 322 in place but allow the ends to move within the gaps defined thereby when the release bar 262 is pulled outwardly by the user of the display system.

The narrowed front section 328 of the release bar 262 includes a grasp opening 342 formed therein which defines a tab 344 between the opening 342 and the front edge of the release bar 262. The opening 342 and tab 344 of the release bar 262 may be easily grasped by the store owner to remove a module 122 from the frame assembly 120.

To remove a selected module 122 from the frame assembly 120 of the merchandise display system, the store owner pulls outwardly, away from the front opening 224 of the module, on the narrowed front end section 328 of the release bar 262, which is situated under the UPC panel 228. When the store owner pulls on the release bar 262, the extended portion 320 of the locking wings 188 pivot to force the locking wings to open and disengage from a respective indexing member 132 against the bias of the leaf spring 322. The store owner may remove a module 122 from the frame assembly 120 perpendicularly and outwardly from the front face of the frame assembly. The store owner pulls on the module 122 until the locator protrusions 186 disengage from the arcuate recesses 133 formed in the adjacent indexing members 132 of the respective pair of indexing members on which the module is mounted. The module release mechanism, including the elongated release bar 262, is contained substantially entirely within the module 122 and under the UPC panel 228, and does not interfere with the closely spaced, adjacent modules mounted on the frame assembly 120.

Figure 43:
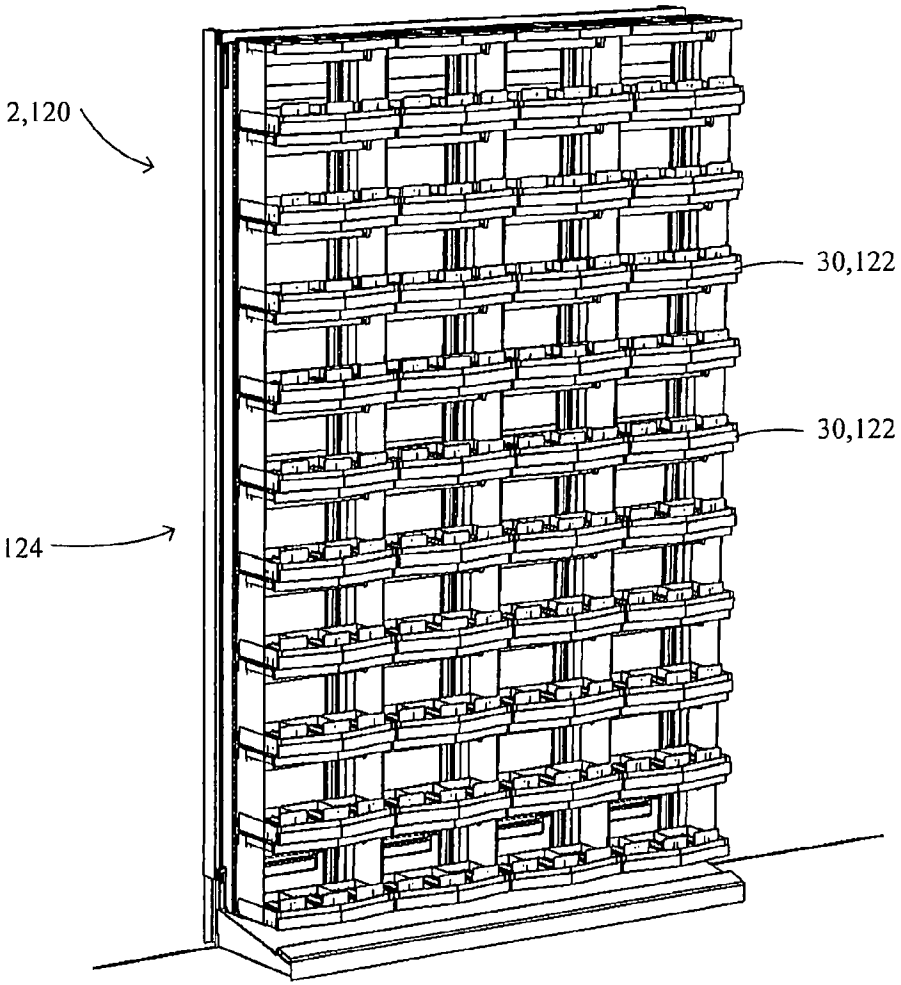
FIG. 43 is a front perspective view of the merchandise display system of the present invention shown mounted on a supporting wall in an establishment.

As can be seen from FIG. 43 of the drawings, a plurality of modules 30, 122 may be mounted on the frame 2, 120 in rows and columns and closely situated next to one another. Each module 30, 122 may be removed directly from the front of the frame 2, 120 without the need for tilting the module 30, 122 or disturbing adjacent modules. Thus, the display system of the present invention can provide a higher density of items of merchandise than conventional merchandise display systems.

Although the modules 30, 122 having one or more trays 42, 230 are described as being mountable on the frame 2, 120 of the modular merchandise display system of the present invention, it should be realized that the trays 42, 230 themselves may include the structure described previously for mounting the modules 30, 122 to the frame 2, 120, including the locking wings 48, 188, the locator protrusions (pins) 46, 186 and the components of the release mechanism, to releasably mount the trays 42, 230 directly to the frame 2, 120 of the display system, without the need to use the modules 30, 122 described herein, and such structure is envisioned to be within the scope of the present invention.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A modular merchandise display system, which comprises:

a frame, the frame having a pair of spaced apart, parallelly disposed indexing members, each indexing member having a plurality of openings formed therein; and a plurality of merchandise supporting units, each merchandise supporting unit having a front side and an opposite rear side, and at least a pair of spaced apart locator protrusions extending outwardly from the rear side thereof, the locator protrusions of each merchandise supporting unit being at least partially receivable in corresponding openings in each indexing member of the pair of indexing members, such that the merchandise supporting units may be removably mounted on the frame;

wherein each merchandise supporting unit includes at least one pair of locking wings extending outwardly from the rear side of the merchandise supporting unit, the at least one pair of locking wings including a first locking wing and a second locking wing, the first and second locking wings being spaced apart from each other a predetermined distance so that each of the first and second locking wings can selectively engage a corresponding indexing member of the pair of indexing members to help secure the merchandise supporting units to the indexing members of the frame;

wherein each merchandise supporting unit includes a release mechanism, the release mechanism being operatively coupled to the first and second locking wings to effect the disengagement of the first and second locking wings from the corresponding indexing members; and wherein the release mechanism includes an elongated release bar and first and second lever arms, the release bar being reciprocatingly movable and extending in a direction between the front side and the rear side of a respective merchandise supporting unit, the release bar having a first axial end portion situated in proximity to the front side of a respective merchandise supporting unit and a second axial end portion situated opposite the first axial end portion, each of the first and second lever arms having a first axial end portion and a second axial end portion situated opposite the first axial end portion, the second axial end portions of the first and second lever arms being moveably joined to the second axial end portion of the release bar, the first axial end portion of the first lever arm being moveably joined to the first locking wing, and the first axial end portion of the second lever arm being moveably joined to the second locking wing, each of the first lever arm and the second lever arm being pivotable about respective first and second lever arm pivot axes, and each of the first and second locking wings being pivotable about respective first and second locking wing pivot axes, whereby movement of the release bar effects pivotal movement of the first and second lever arms respectively about the first and second lever arm pivot axes, which correspondingly effects pivotal movement of the first and second locking wings respectively about the first and second locking wing pivot axes to selectively disengage the first and second locking wings from the corresponding indexing members for removing the merchandise supporting unit from the frame.

2. A modular merchandise display system as defined by claim 1, wherein each of the first locking wing and the second locking wing has a main body and a free end extending from the main body, the main body being formed with a recess, and the free end defining a camming surface situated in proximity to the recess of the main body, each of the first and second locking wings being biased toward engagement with a corresponding indexing member of the pair of indexing members such that the camming surfaces of the first and second locking wings first engage the corresponding indexing members and the recesses of the first and second locking wings at least partially receive the corresponding indexing members when the merchandise supporting units are mounted on the frame.

3. A modular merchandise display system as defined by claim 1, wherein the first and second locking wings are biased in a direction which is one of 1) towards one another to thereby receive the pair of indexing members between the first and second locking wings, and 2) away from one another so that the first and second locking wings are received between the pair of indexing members.

4. A modular merchandise display system as defined by claim 1, wherein the first axial end of the release bar includes structure being graspable by a user of the modular merchandise display system to effect movement of the release bar.

5. A modular merchandise display system as defined by claim 4, wherein the graspable structure includes a tab situated at the first axial end of the release bar.

6. A modular merchandise display system as defined by claim 1, wherein the first axial end of the release bar has formed therein an opening for grasping by a user of the modular merchandise display system to effect movement of the release bar.

7. A modular merchandise display system as defined by claim 1, wherein each merchandise supporting unit is in the form of a box-like module, each module being mountable to the frame adjacent either horizontally or vertically another module.

8. A modular merchandise display system as defined by claim 7, wherein at least some of the modules include a resilient header which is deflectable by a user of the module merchandise display system to facilitate the user grasping the structure of the release bar of an adjacent module to effect movement of the release bar of the adjacent module and the removal of the adjacent module from the frame.

9. A modular merchandise display system as defined by claim 1, wherein at least one of the merchandise supporting units is in the form of one of a tray and a box-like module.

10. A modular merchandise display system as defined by claim 1, wherein each indexing member of the pair of indexing members includes a lateral side, the lateral side of one indexing member of the pair of indexing members facing the lateral side of the other indexing member of the pair of indexing members; and wherein each opening of the plurality of openings formed in each indexing member of the pair of indexing members is defined as an open recess formed in the lateral side of the one indexing member which faces the lateral side of the other indexing member, the locator protrusions of the merchandise supporting units being at least partially receivable by corresponding open recesses formed in the indexing members of the pair of indexing members.

11. A modular merchandise display system as defined by claim 1, wherein each indexing member of the pair of indexing members includes a locking rail extending along the length thereof, and wherein each of the first locking wing and the second locking wing has a free end defining a camming surface and a hooked end situated in proximity to the camming surface thereof, the hooked ends of the first and second locking wings being engageable with the locking rails of corresponding indexing members of the pair of indexing members when the merchandise supporting units are mounted on the frame.

12. A modular merchandise display system as defined by claim 1, wherein at least one merchandise supporting unit is in the form of a box-like module which is mountable to the frame.

13. A modular merchandise display system as defined by claim 12, wherein the module includes a tray for holding merchandise thereon, the module further including a frame defining an interior space, the tray being reciprocatingly movably mounted to the frame of the module within the interior space thereof so as to be at least partially extendible from and retractable within the interior space of the frame of the module.

14. A modular merchandise display system as defined by claim 12, wherein the module includes a hook bar for receiving a plurality of hooks for holding merchandise, the module further including a frame defining an interior space, the hook bar being mounted on the frame of the module so that hooks mountable to the hook bar extend into the interior space of the frame of the module.

15. A modular merchandise display system, which comprises:

a frame, the frame having a pair of spaced apart, parallelly disposed indexing members, each indexing member having a plurality of openings formed therein; and a plurality of merchandise supporting units, each merchandise supporting unit having a front side and an opposite rear side, and at least a pair of spaced apart locator protrusions extending outwardly from the rear side thereof, the locator protrusions of each merchandise supporting unit being at least partially receivable in corresponding openings in each indexing member of the pair of indexing members, such that the merchandise supporting units may be removably mounted on the frame;

wherein each merchandise supporting unit includes at least one pair of locking wings extending outwardly from the rear side of the merchandise supporting unit, the at least one pair of locking wings including a first locking wing and a second locking wing, the first and second locking wings being spaced apart from each other a predetermined distance so that each of the first and second locking wings can selectively engage a corresponding indexing member of the air of indexing members to help secure the merchandise supporting units to the indexing members of the frame; and wherein each indexing member of the pair of indexing members includes a first lateral side and a second lateral side situated opposite the first lateral side, the first lateral side of one indexing member of the pair of indexing members facing the first lateral side of the other indexing member of the pair of indexing members, the second lateral side of one indexing member of the pair of indexing members not facing the second lateral side of the other indexing member of the pair of indexing members; and wherein each opening of the plurality of openings formed in each indexing member of the pair of indexing members is defined as an open recess formed in the non-facing second lateral sides of the indexing members, the locator protrusions of the merchandise supporting units being at least partially receivable by corresponding open recesses formed in the indexing members of the pair of indexing members.

16. A modular merchandise display system as defined by claim 15, wherein each merchandise supporting unit includes a release mechanism, the release mechanism being operatively coupled to the first and second locking wings to effect the disengagement of the first and second locking wings from the corresponding indexing members.

17. A modular merchandise display system as defined by claim 16, wherein the release mechanism includes an elongated release bar, the release bar being reciprocatingly movable and extending in a direction between the front side and the rear side of a respective merchandise supporting unit, the release bar having a first axial end portion situated in proximity to the front side of a respective merchandise supporting unit and a second axial end portion situated opposite the first axial end portion, the first locking wing and the second locking wing being movably joined to the second axial end portion of the release bar, each of the first and second locking wings being pivotable about respective first and second locking wing pivot axes, whereby movement of the release bar effects pivotal movement of the first and second locking wings respectively about the first and second locking wing pivot axes to selectively disengage the first and second locking wings from the corresponding indexing members for removing the merchandise supporting unit from the frame.

18. A modular merchandise display system as defined by claim 17, wherein the first axial end of the release bar includes structure being graspable by a user of the modular merchandise display system to effect movement of the release bar.

19. A modular merchandise display system as defined by claim 18, wherein the graspable structure includes a tab situated at the first axial end of the release bar.

20. A modular merchandise display system as defined by claim 17, wherein the first axial end of the release bar has formed therein an opening for grasping by a user of the modular merchandise display system to effect movement of the release bar.

21. A modular merchandise display system as defined by claim 17, wherein each merchandise supporting unit is in the form of a box-like module, each module being mountable to the frame adjacent either horizontally or vertically another module.

22. A modular merchandise display system as defined by claim 15, wherein each of the indexing members includes a locking rail extending along the length thereof.

23. A modular merchandise display system as defined by claim 22, wherein the locking rail of each indexing member of the pair of indexing members extends from the first lateral side thereof.

24. A modular merchandise display system as defined by claim 15, wherein each indexing member of the pair of indexing members includes a locking rail extending along the length thereof, and wherein each of the first locking wing and the second locking wing has a free end defining a camming surface and a hooked end situated in proximity to the camming surface thereof, the hooked ends of the first and second locking wings being engageable with the locking rails of corresponding indexing members of the pair of indexing members when the merchandise supporting units are mounted on the frame.

25. A modular merchandise display system as defined by claim 15, wherein at least one merchandise supporting unit is in the form of a box-like module which is mountable to the frame.

26. A modular merchandise display system as defined by claim 15, wherein each merchandise supporting unit is in the form of a box-like module, each module being mountable to the frame adjacent either horizontally or vertically another module.

27. A modular merchandise display system as defined by claim 25, wherein the module includes a tray for holding merchandise thereon, the module further including a frame defining an interior space, the tray being reciprocatingly movably mounted to the frame of the module within the interior space thereof so as to be at least partially extendible from and retractable within the interior space of the frame of the module.

28. A modular merchandise display system as defined by claim 25, wherein the module includes a hook bar for receiving a plurality of hooks for holding merchandise, the module further including a frame defining an interior space, the hook bar being mounted on the frame of the module so that hooks mountable to the hook bar extend into the interior space of the frame of the module.

29. A modular merchandise display system as defined by claim 15, wherein at least one of the merchandise supporting units is in the form of one of a tray and a box-like module.

30. A modular merchandise display system as defined by claim 15, wherein each of the first locking wing and the second locking wing has a main body and a free end extending from the main body, the main body being formed with a recess, and the free end defining a camming surface situated in proximity to the recess of the main body, each of the first and second locking wings being biased toward engagement with a corresponding indexing member of the pair of indexing members such that the camming surfaces of the first and second locking wings first engage the corresponding indexing members and the recesses of the first and second locking wings at least partially receive the corresponding indexing members when the merchandise supporting units are mounted on the frame.

* * * * *